US005775993A

United States Patent [19]

Fentz et al.

[11] Patent Number: 5,775,993

[45] Date of Patent: Jul. 7, 1998

[54] ROULETTE GAMING MACHINE

[75] Inventors: Barry W. Fentz; D. Bradly Olah, both of Plymouth; Donald F. Lovely, Bloomington; Cory James Hanscom, New Hope, all of Minn.

[73] Assignee: Innovative Gaming Corporation of America, Reno, Nev.

[21] Appl. No.: 594,807

[22] Filed: Jan. 31, 1996

[51] Int. Cl.[6] ..... A63F 5/00

[52] U.S. Cl. ..... 463/17; 463/31; 463/22

[58] Field of Search ..... 463/16, 17, 22, 463/31, 34; 273/142 E, 142 R; 364/412

[56] References Cited

U.S. PATENT DOCUMENTS

| | | | |
|---|---|---|---|
| D. 251,395 | 3/1979 | Kula | D21/37 |
| D. 261,782 | 11/1981 | Muir | D21/37 |
| D. 276,630 | 12/1984 | Gimbel | D21/37 |
| D. 364,650 | 11/1995 | Hanscom | D21/37 |
| D. 371,579 | 7/1996 | Hanscom | D21/37 |
| 3,940,138 | 2/1976 | Ochi | 273/86 B |
| 4,321,673 | 3/1982 | Hawwass et al. | 463/17 |
| 4,836,553 | 6/1989 | Suttle et al. | 273/292 |
| 5,098,107 | 3/1992 | Boylan et al. | 273/292 |
| 5,221,083 | 6/1993 | Dote | 463/34 |
| 5,588,650 | 12/1996 | Eman et al. | 463/17 |

*Primary Examiner*—Jessica Harrison
*Assistant Examiner*—James Schaaf
*Attorney, Agent, or Firm*—Merchant, Gould, Smith, Edell, Welter & Schmidt, P.A.

[57] ABSTRACT

An electronic gaming machine that closely emulates the actions, look and feel of a live action roulette game including betting table layout, roulette wheel operation and croupier interactions with the game players is accomplished by a CRT displayed game table and a tower CRT displaying the graphic image of a roulette wheel and the video appearance and speech of the dealer. The roulette game consists of five player stations surrounding a simulated game table consisting of two large horizontal CRT monitors which display the roulette betting field. The game is firmware controlled from a game table chassis which communicates with each player station and with the tower video system. Each player via a track ball and control buttons, places or deletes bets on the displayed betting field during the wagering phase. As the game progresses announcements to the players appear on the CRT betting table and on the tower video monitor by the live video appearance of the current game dealer. The game tower monitor displays a spinning roulette wheel, and a computer graphics overlay ball (sprite) which rotates on the roulette wheel rim, drops from the rim, bounces and eventually stops at a randomly selected winning number on the spinning roulette wheel in a manner closely emulating the operation of an actual roulette wheel. Developed and prerecorded video graphic images from a laser disk player or from a PC hard disk drive together with computer controlled overlay graphics provides the roulette wheel, roulette ball, croupier appearance and her/his voice announcements. Moreover, selection of one of a plurality of bounce patterns reduces repetitive ball movements during different rounds, thereby providing more realistic simulation of an actual roulette game.

30 Claims, 18 Drawing Sheets

ROULETTE GAMING MACHINE

FIELD OF THE INVENTION

The invention relates to an electronic gaming machine. More particularly, the invention relates to an electronic gaming machine for playing the game of roulette which simulates the movement of a game ball and a roulette wheel.

BACKGROUND OF THE INVENTION

Electronic gaming machines have been created to simulate a number of different casino games, including blackjack, craps, slot machines, etc. Many electronic gaming machines are restricted to a single player, as in the case of electronic slot machines. However, other electronic gaming machines have been developed as multi-player units which enable multiple players to participate in games. As an example, of multi-player machines, U.S. Pat. Nos. 4,614,342 to Takashima and 5,263,715 to Matsumoto et al. generally disclose multi-station "electronic" Blackjack and Craps games which are available, for example, from Innovative Gaming Corporation of America (IGCA), the assignee of the present invention.

The Craps game, for example, features a dealer station/game table playing field surrounded by multiple player stations. The dealer station includes two large horizontally mounted CRT monitors displaying the playing field, and each playing station permits a player to independently place or delete bets on the selected betting fields. The dealer station utilizes electronic logic (firmware) which controls the game sequence, rolls the dice, provides and controls the CRT display of the game field, and independently interfaces with the player stations.

Each player station utilizes electronic logic (firmware) to enable a player via a track ball to move a video hand across the playing field and place specific bets. Betting and other information is transmitted over an interface to permit the dealer station to actually display the bets on the betting field.

Both single player and multi-player electronic gaming machines have enjoyed growing popularity. In part, the electronic games have become popular with novice players, as they generally avoid the apprehension which is commonly encountered by novice players when dealing with live game operators.

To maximize the enjoyment, and thus the profitability, of an electronic gaming machine, it is important for the machine to be easy to learn and use. Moreover, it has also been found to be important for the machine to simulate a live action game as closely as possible so that users have the feeling that they are participating in a real live action game.

Many of the above-listed casino games, e.g., blackjack and craps, have been electronically simulated to the satisfaction of most players. However, a substantial need has also arisen for an electronic gaming machine which realistically simulates the game of roulette.

Prior attempts to simulate roulette in an electronic gaming machine have not had significant success because the primary visual element of live action roulette, the interaction of a game ball and a spinning roulette wheel, has heretofore not been accurately simulated. Prior attempts are characterized by crude graphical representations, poor audio, and unrealistic ball movements, all of which result in unrealistic games that are not desirable to players.

Therefore, a substantial need has existed for an electronic roulette gaming machine which more accurately and realistically simulates live action roulette, specifically with regard to the interaction of a game ball with a spinning roulette wheel.

SUMMARY OF THE INVENTION

The invention addresses these and other problems associated with the prior art in providing an electronic roulette gaming machine incorporating realistic game ball movement simulation in relation to a spinning roulette wheel. Two primary techniques have been found to improve the realism of the movement of game ball in a graphical simulation, although each may also be implemented separately in electronic roulette gaming machines consistent with the invention.

One technique involves the superimposition of a computer generated graphical representation of a game ball over a pre-recorded video graphic image of a roulette wheel spinning at a constant rate. With this technique, the processing is basically limited to the generation and movement of a graphic image of the ball, as it has been found that the movement (in particular, the spin rate) of a physical roulette wheel does not substantially change during the ball spin and drop phase, and thus can be accurately simulated with a pre-recorded image. With the reduction in processing, development of the machine is substantially simplified, and less powerful (and thus less expensive) hardware may be used to implement the machine.

Another technique generates a bounce pattern for a game ball by selecting from a plurality of preset bounce patterns such that repeated simulations of a game ball movement do not result in identical bounce patterns. By a "bounce pattern", what is meant is the manner in which a game ball bounces between the time period in which the ball drops from the upper rim of a roulette wheel and the time in which the ball lands and rests in one of the numbered bins on the roulette wheel. It has been found that actual game balls may bounce around a roulette wheel in many different patterns. The plurality of observed bounce patterns from which a bounce pattern is selected may be selected randomly, and further may be synthesized from analysis of actual, or observed, ball bounce movements. When coupled with a random winning number, a widely varying range of ball movements may be experienced by players during the course of a gaming session, thus enhancing the realism of the machine.

Therefore, in accordance with one aspect of the invention, there is provided an electronic roulette gaming apparatus, which includes a display; a storage device outputting a pre-recorded graphic image of a spinning roulette wheel to the display; and a controller outputting a superimposed graphic image of a ball to the display, wherein the controller synchronizes movement of the graphic image of the ball with the pre-recorded graphic image of the spinning roulette wheel to simulate movement of a ball on a roulette wheel.

In accordance with an additional aspect of the invention, there is provided an electronic roulette gaming apparatus, which includes first display means for displaying a graphic image of a spinning roulette wheel on a display; determining means for determining a path for movement of a graphic image of a ball on the display relative to the graphic image of the spinning roulette wheel, wherein the determining means selects a bounce pattern for the graphic image of the ball from a plurality of different bounce patterns, each bounce pattern for moving the graphic image of the ball from an outer track to an inner track of the graphic image of the spinning roulette wheel; and second display means for displaying the graphic image of the ball on the display and moving the graphic image of the ball relative to the graphic image of the spinning roulette wheel to follow the path.

According to a further aspect of the invention, a method of playing roulette is provided. The method includes the steps of playing a pre-recorded graphic image of a spinning roulette wheel on a display; superimposing a graphic image of a ball over the pre-recorded graphic image of the spinning roulette wheel; determining a path for movement of the graphic image of the ball relative to the pre-recorded graphic image of the spinning roulette wheel; and synchronizing movement of the graphic image of the ball along the path with the playing of the pre-recorded graphic image of the spinning roulette wheel.

In accordance with an additional aspect of the invention, a method of playing roulette is provided. The method includes the steps of: displaying a graphic image of a spinning roulette wheel on a display; displaying a graphic image of a ball over the graphic image of the spinning roulette wheel; determining a path for movement of the graphic image of the ball relative to the graphic image of the spinning roulette wheel including the step of selecting a bounce pattern for the graphic image of the ball from a plurality of different bounce patterns, each bounce pattern for moving the graphic image of the ball from an outer track to an inner track of the graphic image of the spinning roulette wheel; and moving the graphic image of the ball relative to the graphic image of the spinning roulette wheel to follow the path.

According to another aspect of the invention, a program storage device readable by a computer system coupled to a display is provided. The program storage device tangibly embodies a program of instructions executable by the computer system to simulate a live action roulette game on the display. The program includes first display means for displaying a graphic image of a spinning roulette wheel on the display; determining means for determining a path for movement of a graphic image of a ball on the display relative to the graphic image of the spinning roulette wheel, wherein the determining means selects a bounce pattern for the graphic image of the ball from a plurality of different bounce patterns, each bounce pattern for moving the graphic image of the ball from an outer track to an inner track of the graphic image of the spinning roulette wheel; and second display means for displaying the graphic image of the ball on the display and moving the graphic image of the ball relative to the graphic image of the spinning roulette wheel to follow the path.

These and other advantages and features, which characterize the invention, are set forth in the claims annexed hereto and forming a further part hereof. However, for a better understanding of the invention, and of the advantages and features attained by its use, reference should be made to the Drawing, and to the accompanying descriptive matter, in which there is described preferred embodiments of the invention.

DETAILED DESCRIPTION OF THE PREFERRED EMBODIMENTS

Figure 1:
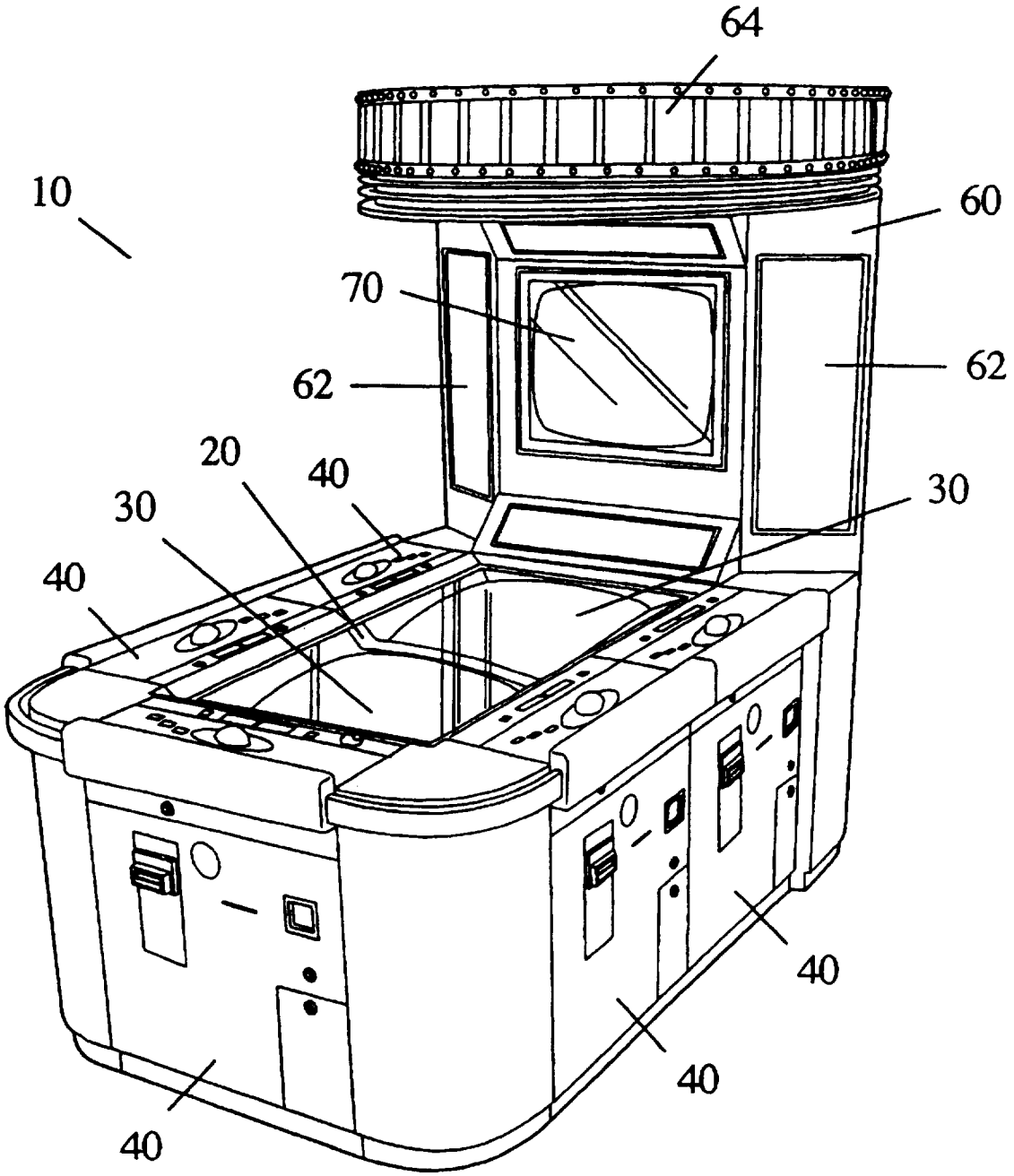
FIG. 1 is a perspective view of an electronic roulette gaming machine consistent with the present invention.

Turning to the Drawing, wherein like numbers denote like parts throughout the several views, FIG. 1 shows a preferred electronic roulette gaming machine 10 consistent with principles of the invention. Gaming machine 10 generally includes three primary components: a playing field (game table) 20, a plurality of player stations 40, and a tower 60.

Hardware/Mechanical Configuration

In a live action game of roulette, a player at, at least one of the player stations, places a bet on a central roulette table during a betting period. The dealer then rolls a game ball around the rim of a spinning roulette wheel. Rolling friction and gravitational force soon cause the ball to drop from the roulette rim and bounce and come to rest on a specific "winning number" pocket or bin. Depending on the positioning of the player chips on the betting field a range of payout amounts are credited or paid out to the winning players.

Similarly, in the preferred embodiment, five player stations 40 are connected to three sides of game table 20, and a pair of horizontally positioned monitors 30 present the layout of a standard roulette table playing field. Tower 60 provides a roulette wheel display and the appearance of one or more "live" dealers and their game announcements via a monitor 70. Additionally, the tower provides panels 62 listing game rules and betting odds and also an ornamentally lit canopy 64.

Figure 2:
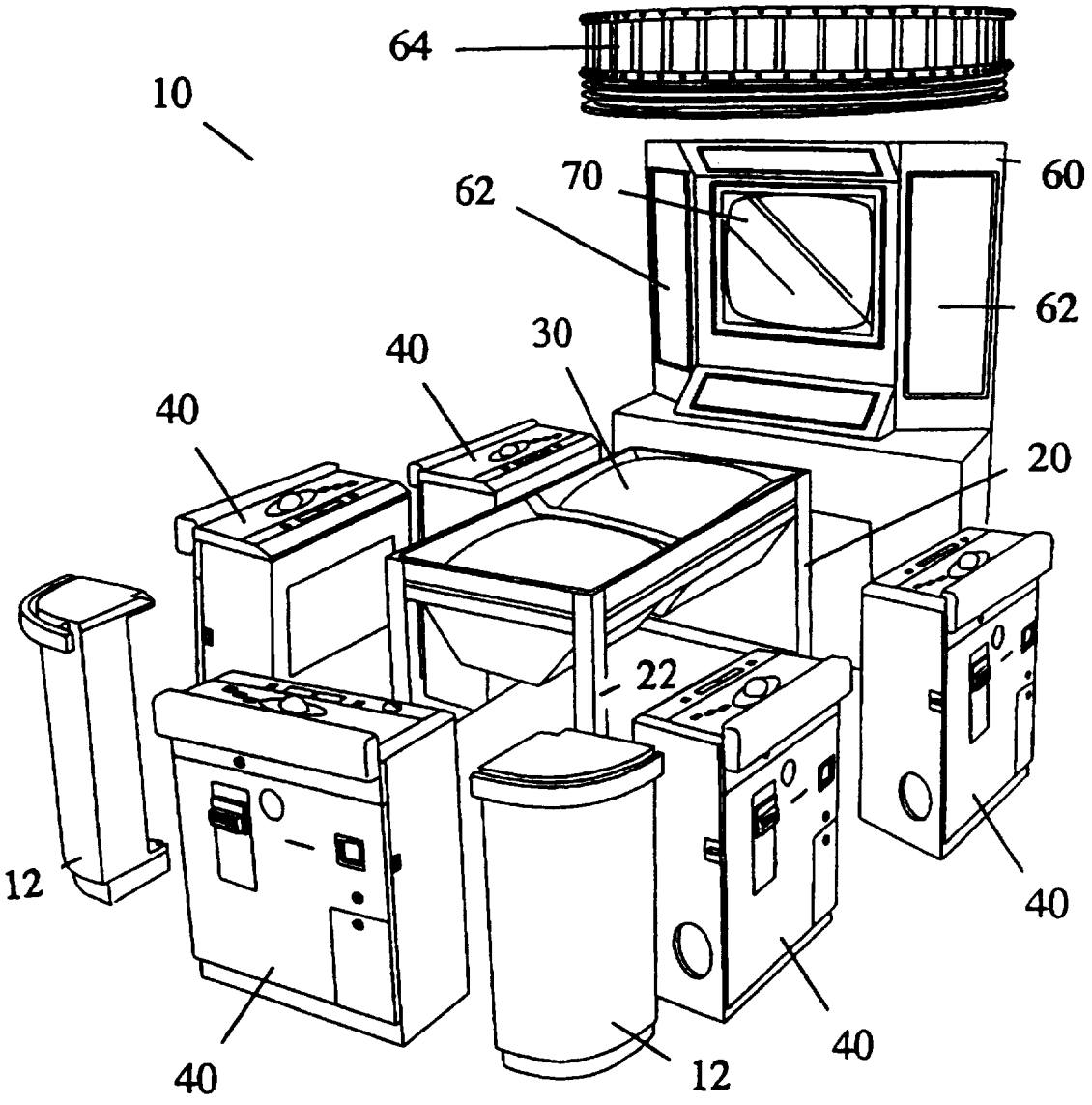
FIG. 2 is an exploded perspective view of the main physical assemblies comprising the gaming machine of FIG. 1.

FIG. 2 shows the actual modular design of the roulette device, which consists of eight electromechanical assemblies (game table 20, five player stations 40, video tower 60 and tower canopy 64) and two corner pieces 12. Each game device is mechanically assembled by securing tower canopy 64 to tower 60, the tower to game table 20, and each player station 40 to the game table and to its adjacent player station and adjacent corner piece or tower. The assemblies are preferably bolted together to provide a rigid, solid mechanical structure. Additionally, a quick disconnect power and signal interface (shown functionally by reference numbers 23, 24 in FIG. 3) exists between tower 60 and game table 20 and between game table 20 and each player station 40.

Figure 3A:
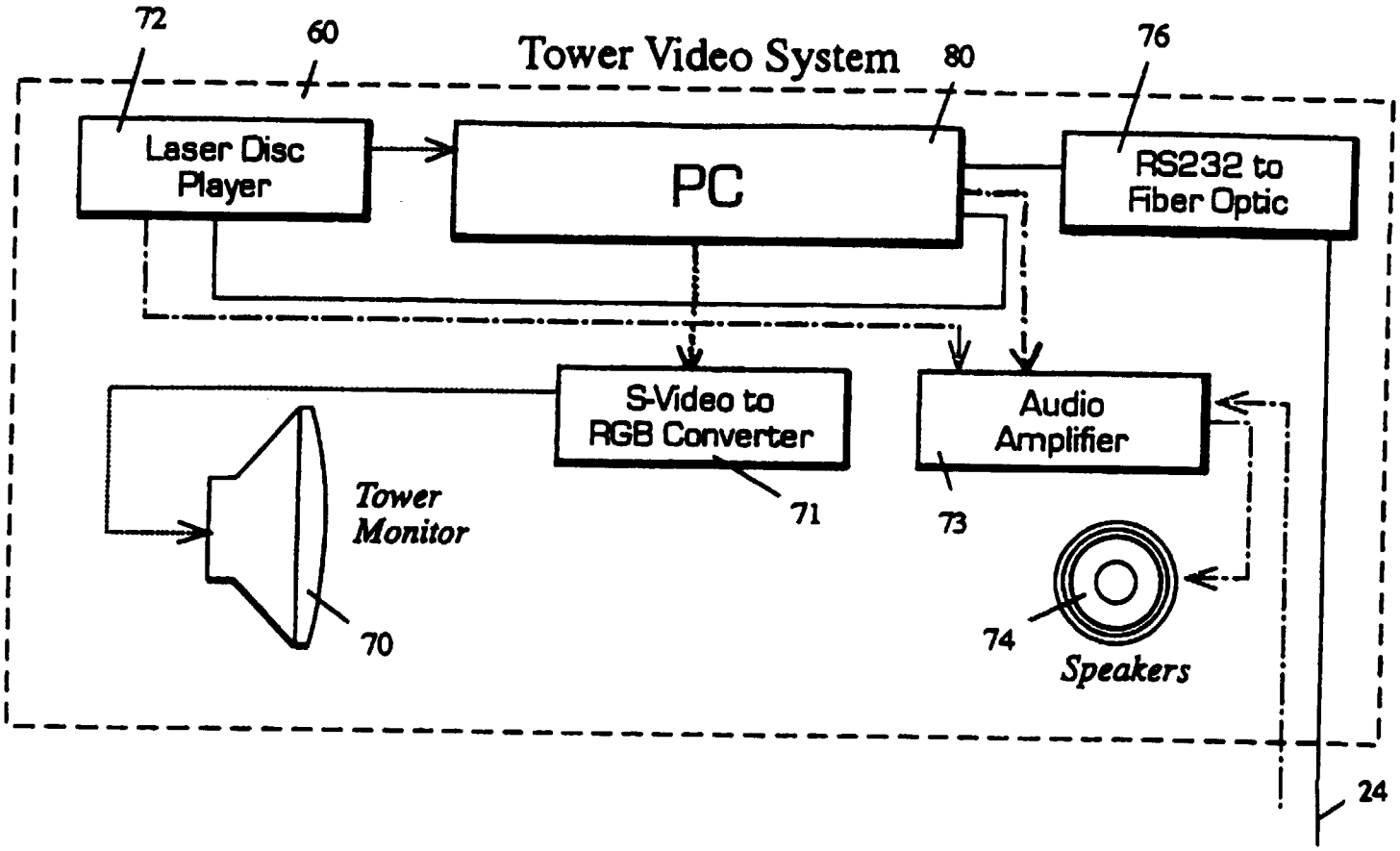
FIG. 3 is an overview block diagram of the primary electronic components in the gaming machine of FIG. 1.
Figure 3B:
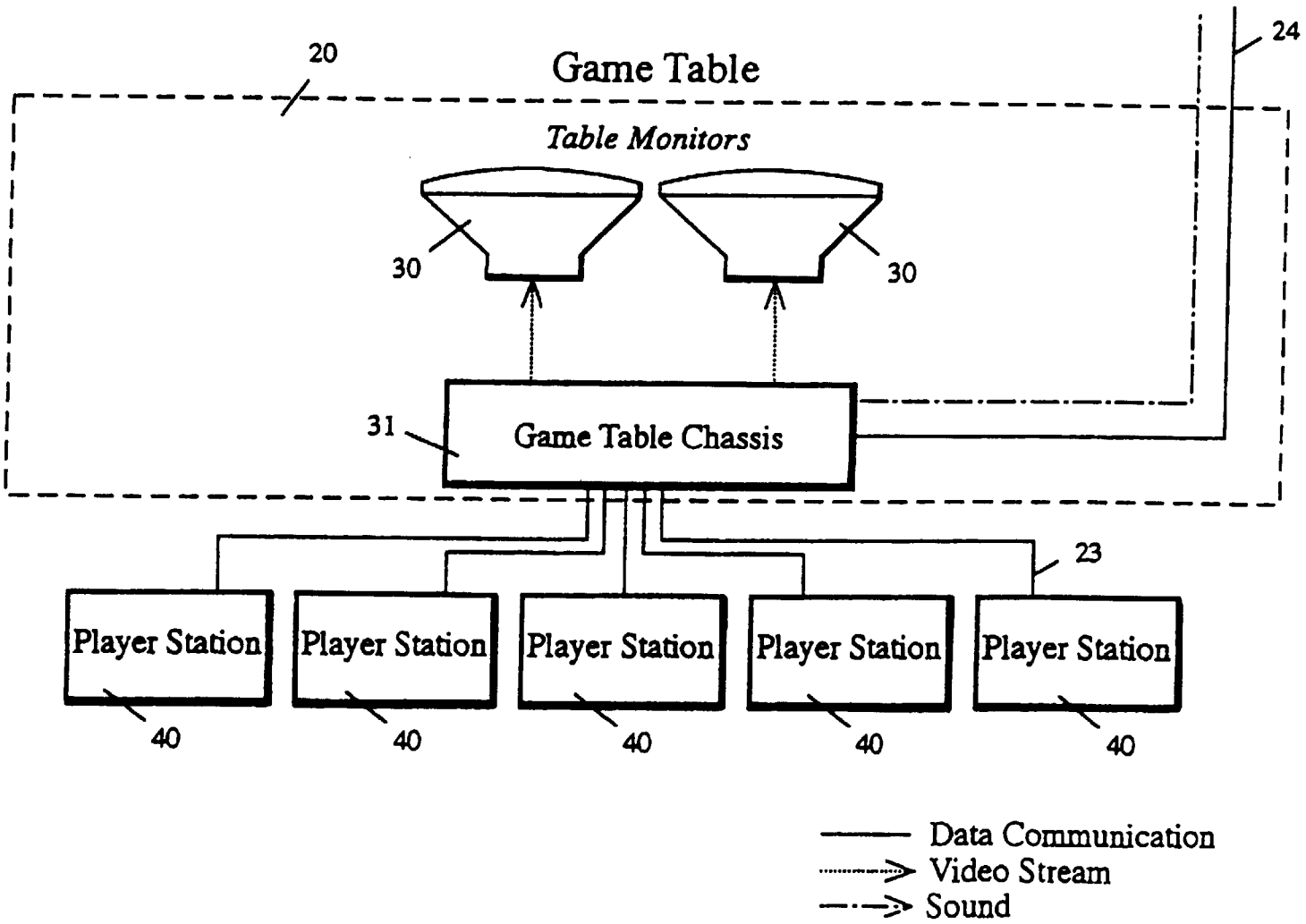

The logical and signal interconnection of the principal device components are shown in the component configuration diagram of FIG. 3. Primary game operation is controlled by a game table (dealer) chassis or controller 31 in game table 20, which communicates via two way fiber optic lines 23 with each player station 40.

Each player station 40 preferably receives player inputs and transmits the inputs to game table chassis 31, which then moves and displays betting hands on monitors 30, and registers and displays the bets (chips) placed by each player. Game table chassis 31 preferably contains the program logic and electronics necessary to display the roulette betting field, the aforementioned player station hands and betting chips on monitors 30.

Game table chassis 31 also communicates via fiber optic cable 24 and RS232 to Fiber Optic converter 76 with a controller such as tower video control computer (PC) 80 in tower 60. Game table chassis 31 through tower PC 80 thereby coordinates the overall timing and selection of the video segments that display on tower monitor 70 and synchronizes these segments with the displays on monitors 30.

Tower PC 80 preferably combines overlay graphics with a pre-recorded source of video graphic images and outputs a S-video signal to a display such as monitor 70 through an S-video to RGB converter 71. Other converters may be necessary, or no converter may be needed at all, depending upon the respective types of signals with which tower PC 80 and monitor 70 are compatible. Pre-recorded video graphic images are preferably stored in analog SVHS on a storage device such as laser disk player 72 to provide the live video part of the game including the roulette wheel, dealer appearances, some dealer announcements and game music.

The pre-recorded video graphic images may be stored on any suitable storage device media, e.g., CD-ROMs, magneto-optical media, fixed or removable magnetic disks, non-volatile memories (e.g., ROMs), etc., with player 72 being matched to the specific media used (e.g., CD-ROM readers, magneto-optical readers, hard disk drives, etc.), or even omitted (e.g., with some non-volatile memories). The video graphic images may be stored and processed in any format, e.g., analog VHS, SVHS or RGB video signals, or digital signals such as MPEG or Quicktime compatible formats.

Specific sounds, such as ball noises and winning number announcements, are preferably stored in tower PC 80 and output to an audio amplifier 73 which drives speakers 74. Audio amplifier 73 may also receive sounds from game table chassis 31 (e.g., chip placement, table rake and win sound effects), as well as from laser disk player 72 (e.g., for sounds such as spoken words that must be synchronized with the video graphic images).

Figure 4:
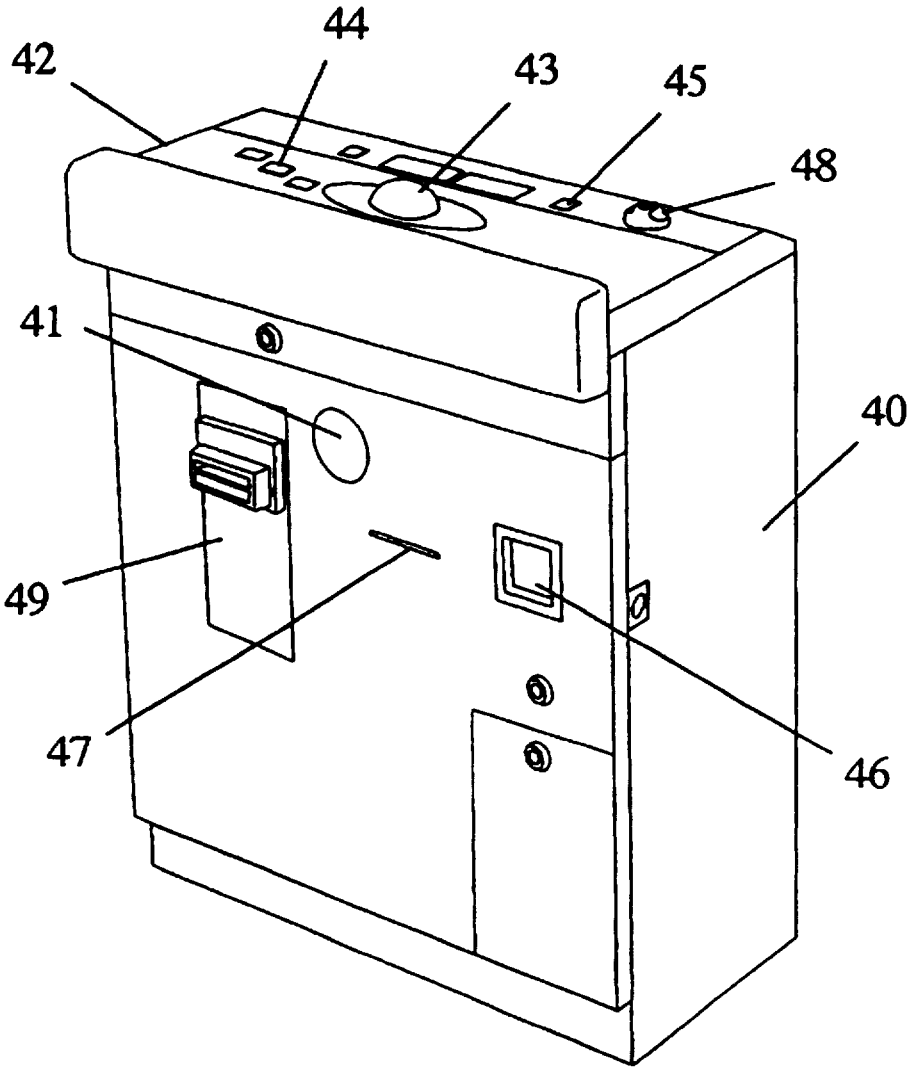
FIG. 4 is a perspective view of one of the player stations of the gaming machine of FIG. 1.

FIG. 4 shows a player station 40 with the several operator controls on its control panel 42, as well as the game devices housed in the player station. Each control panel includes a track ball 43 operable by a player for controlling a displayed hand on the game table and used to select the locations on the game table to place bets. A set of three button switches 44 on control panel 42 enables a player to select one or ten times the standard game credit (bet) amount or to cancel a previous bet. A payout button 45 enables a player to select payout of existing credits, and payout occurs via a coin return hopper 46 or optionally via a ticket printed by a printer 47 if the player station is so equipped. Credits for betting at each player station are established either by a coin input 48 or by a bill insert 49. A speaker 41 produces sound effects for player actions and for player wins.

Figure 5A:
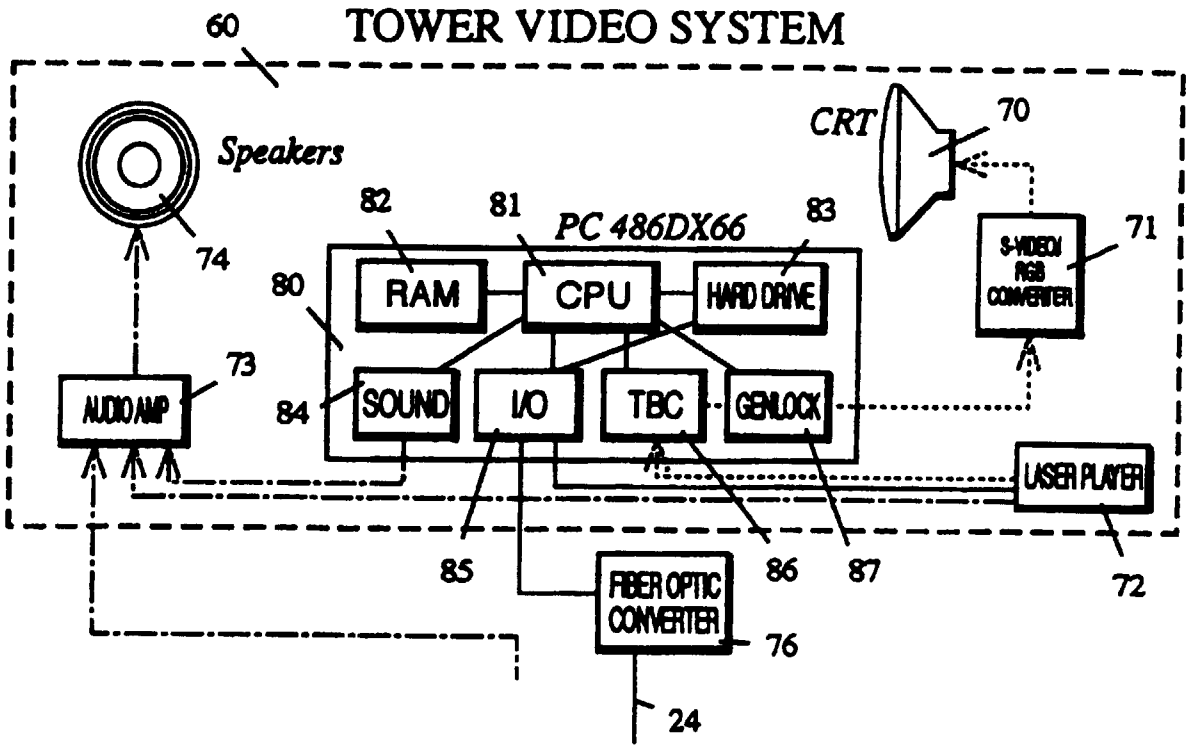
FIG. 5 is a more detailed block diagram of the electronic components in the gaming machine of FIG. 1.
Figure 5B:
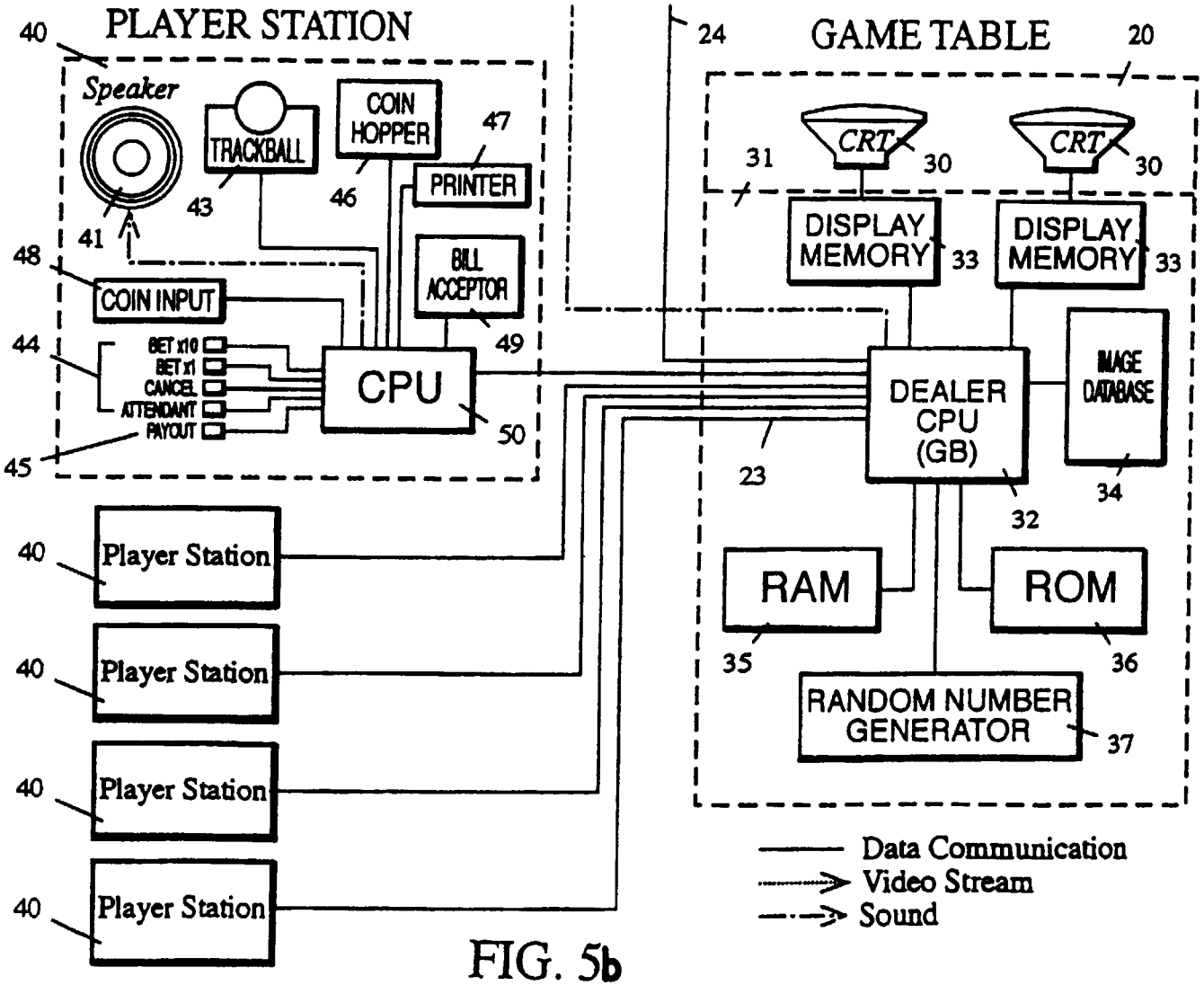

FIG. 5 provides a more detailed schematic block diagram of the complete roulette game machine including the signal connections between the major components. For each player station 40 (only one of which is broken down into its major components), the player various station components shown in FIG. 4 (speaker 41, trackball 43, button switches 44, 45, coin hopper 46, printer 47, coin input 48 and bill acceptor 49) are shown logically again in FIG. 5, with all controls interfacing directly with a player station CPU (Central Processing Unit) 50. Moreover, CPU 50 provides positioning data from trackball 43 and other signals to game table chassis 31 of game table 20 via fiber data line 23, specifically to a game table (dealer) CPU 32. Each of the five player station CPUs 50 connects to a serial port on game table CPU 32.

Dealer CPU 32 is coupled to non-volatile ROM memory devices (preferably EPROM devices) 36 for storing the dealer game program (described below with reference to FIG. 8), and to RAM memory devices 35 for storing various data derived from game play. An image data base (preferably EPROM devices) 34 is also provided for storing game table images (rake, marker, chips and bet hands), and display memories (preferably RAM memory devices) 33 are provided for storing image data corresponding to the front and back halves of the roulette playing field for display respectively on the two CRT displays 30.

The random number generator logic 37 performed by the dealer CPU 32 generates random numbers. Random number generator 37 preferably generates a random number 1 to 38 for American roulette and 1 to 37 for European roulette, with numbers 37 and 38 equating to zero (0) and double zero (00), respectively. These random (winning) numbers as well as control commands for tower 60 are sent by dealer CPU 32 via communication line 24. The dealer CPU also may provide an audio signal to audio amplifier 73 in tower 60 to generate game board sounds (e.g., rake, big player wins).

Many of the above components described for game table 20 and player stations 40 are directly adapted from the aforementioned multi-station electronic Craps game available from IGCA, and thus these components will generally not be discussed in any greater detail herein. However, it will be appreciated that innumerable modifications may be made to the preferred design consistent with the invention.

As discussed above, tower 60 includes a tower PC 80, which is preferably a standard PC-compatible system based upon an Intel x86 microprocessor, such as the 486 DX2/66, and it generally includes the roulette video control program and various peripheral cards (e.g., sound card 84, I/O card 85, time based corrector (TBC) card 86, and genlock card 87) necessary for processing the video and sound signals and for communicating with game table 20.

On power up, a PC CPU 81 loads a display board routine or program 150 (described below with reference to FIGS. 9A and 9B) from a hard disk drive 83 into a RAM memory 82. The hard disk drive also preferably contains game sound files (e.g., ball noises and winning number announcements), which are preloaded into the internal RAM memory of sound card 84, which is preferably a Sound Blaster AWE32 sound card available from Creative Labs. The sound card preferably has sufficient internal memory (e.g., 0.5 to 8 MB) to store all of the necessary game sound files at the same time. This permits more reliable synchronization with the video graphic images from laser disk player 72, since any sound file can be accessed and started almost simultaneously when it is preloaded into the sound card. In the alternative, sound file streams may be transferred directly from hard drive 83 to sound card 84 on an as-needed basis; however, it is more difficult to synchronize sounds with video graphic images due to the time required to transfer sound data from the disk drive to the sound card.

Tower PC CPU 81 receives winning numbers and video synchronization commands from game table 20 through control line 24. The fiber optic information transmitted on line 24 is converted to RS232 by converter 76, and input to CPU 81 thru an RS232 port on I/O card 85. The CPU also controls player 72 thru an RS232 port on I/O card 85.

Laser disk player 72 is preferably a CAV (constant angular velocity) laser disk system, such as the Model AG-LD30 available from Panasonic. The video stream from player 72 first goes to TBC (time based corrector) card 86 which is required to provide stable sync signals when the laser player head moves between video segments. The TBC card provides stable and horizontal position adjusted video to genlock card 87 (e.g., the XR200 available from Magni Systems), where the video is overlaid with various graphics (e.g., game announcements, previous winning numbers, roulette ball and current winning number) stored on hard drive 83 and selected by PC CPU 81. The output of genlock card 87 passes video to converter 71 for display on monitor 70.

In the preferred embodiment, the roulette game video stored on laser disk (or an A/V hard disk drive) is an accurate computer constructed three-dimensional graphic image of a spinning roulette wheel with actual live roulette dealer appearances added at the appropriate game points to provide status information to players. In the alternative, pre-recorded footage of an actual spinning roulette wheel may be utilized as the graphic image of the spinning roulette wheel, and/or accurate computer constructed three-dimensional graphics of the roulette dealers may be used. Other graphic elements, be they computer generated or recorded images of actual objects, may also be incorporated into the roulette game video as desired.

The roulette game video is preferably recorded in a set of two segments—a betting phase and a winning number phase. However, because dealer appearances and voicing are preferably embedded into the game video, a total of six video segments are utilized to support three dealers. The tower PC maintains a table of the beginning frame numbers of each video segment and other game points, e.g., when the dealers appear, when the wheel tilts from horizontal to vertical, when the pre-recorded video ball disappears, etc. By frequently querying the laser disk player for the current frame number, the tower PC is capable of accurately synchronizing the display of overlay graphics and the playing of sounds with the game video. In addition, during the transition between the betting phase and the winning number phase, the tower PC preferably generates a fade to a full screen graphic of the last betting phase frame so that the players observe what appears to be continuous video.

Tower PC 80 generally provides three functional components. A first display function for the tower PC is that of coordinating the display of a graphic image of a spinning roulette wheel on the monitor. A second display function for the tower PC is that of coordinating the display of a graphic image of a roulette ball on the monitor, which includes the function of synchronizing the movement of the ball and the roulette wheel. Attendant to this synchronization, the tower PC determines a path for the movement of the ball relative to the roulette wheel such that the ball moves and lands in a winning number bin on the roulette wheel in a realistic manner. While all of these functions are preferably handled by the tower PC, it should be appreciated that the functions may be allocated to one or more other devices, and that additional functionality may be incorporated into the machine as desired.

Figure 6:
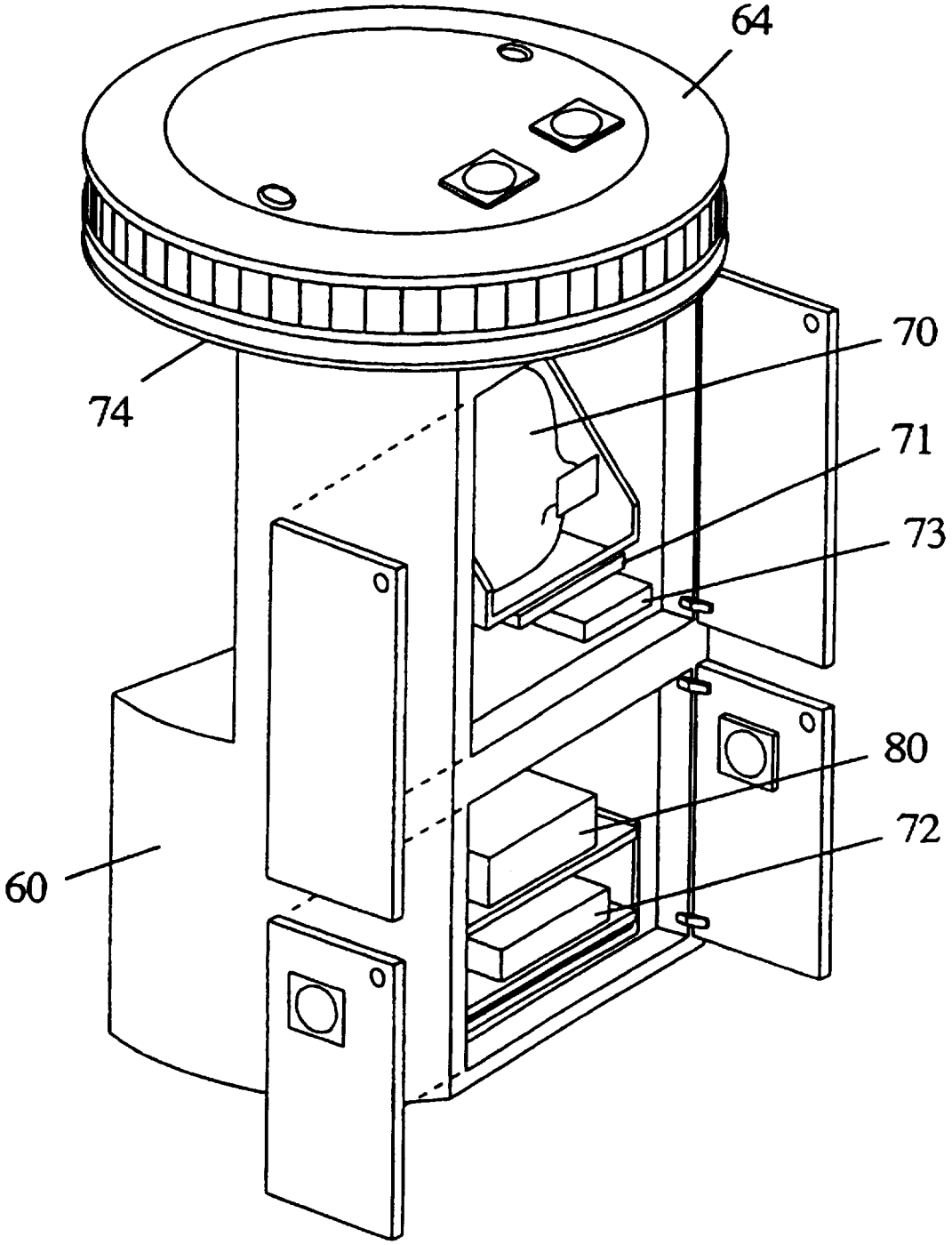
FIG. 6 is a rear perspective view of the video tower in the gaming machine of FIG. 1.
Figure 7:
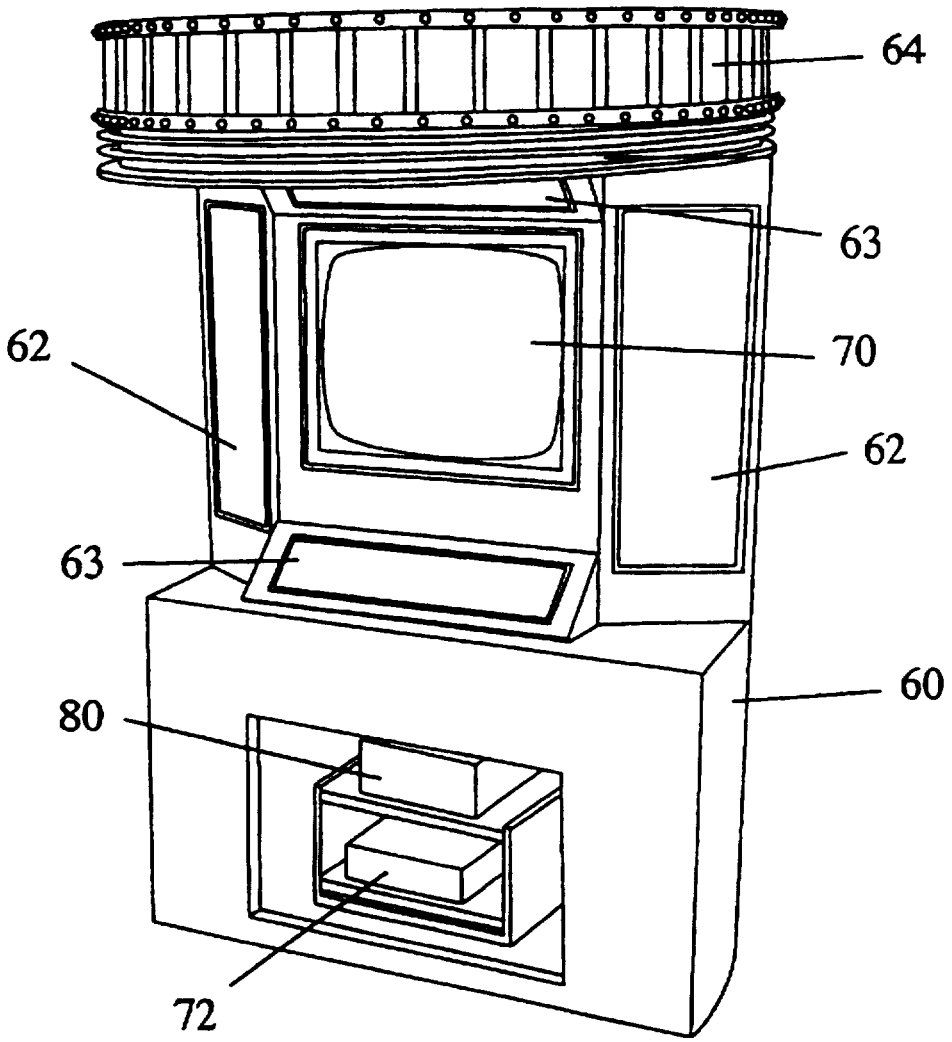
FIG. 7 is a front perspective view of the video tower of FIG. 6.

FIG. 6 presents an isometric rear view of tower 60 showing the major components of the tower, while FIG. 7 shows an isometric front view thereof. Tower canopy 64 is an ornamental part of the tower and houses both colored neon lights, and flashing, circulating lighting which lights the individual betting panel numbers. Canopy 64 also houses the main game speakers 74. The upper part of tower 60 houses monitor 70, converter 71 and audio amplifier 73. In the front view each illuminated panel 62 lists the payout odds, types of bets, game rules and how to play information. Items 63 are decorative, illuminated Live Video Roulette logos. The lower half of tower 60 houses PC 80 and laser disk player 72.

It will be appreciated that various modifications may be made to the mechanical and hardware components of electronic roulette gaming machine 10 consistent with the invention. For example, the various functions allocated to the game table, the tower and the player stations may be allocated to any number of stations, and may be incorporated into a single system. In addition, the functions of the preferred embodiments may be implemented by a software program executing on a general purpose computer, e.g., an IBM- or Macintosh-compatible PC. Other modifications will be apparent to one skilled in the art.

Software Configuration

As discussed above, game board chassis 31 preferably controls the primary operations of electronic roulette gaming machine 10. Game board chassis 31 also sends commands and receives inputs to and from player stations 40 and tower PC 80 to coordinate the activities of the machine.

Figure 8A:
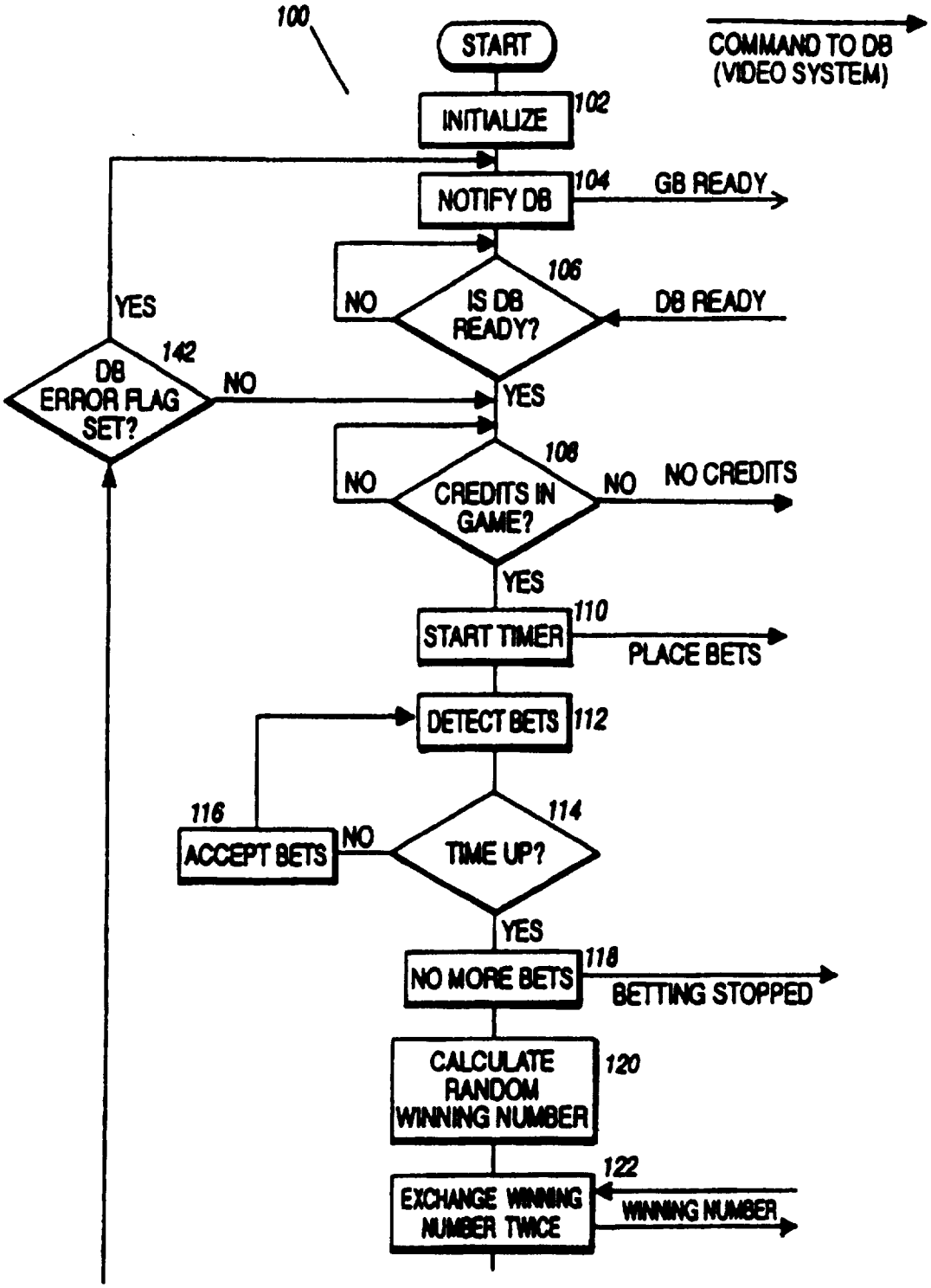
FIG. 8 is a flowchart illustrating the operation of a game table (GB) routine in the gaming machine of FIG. 1.
Figure 8B:
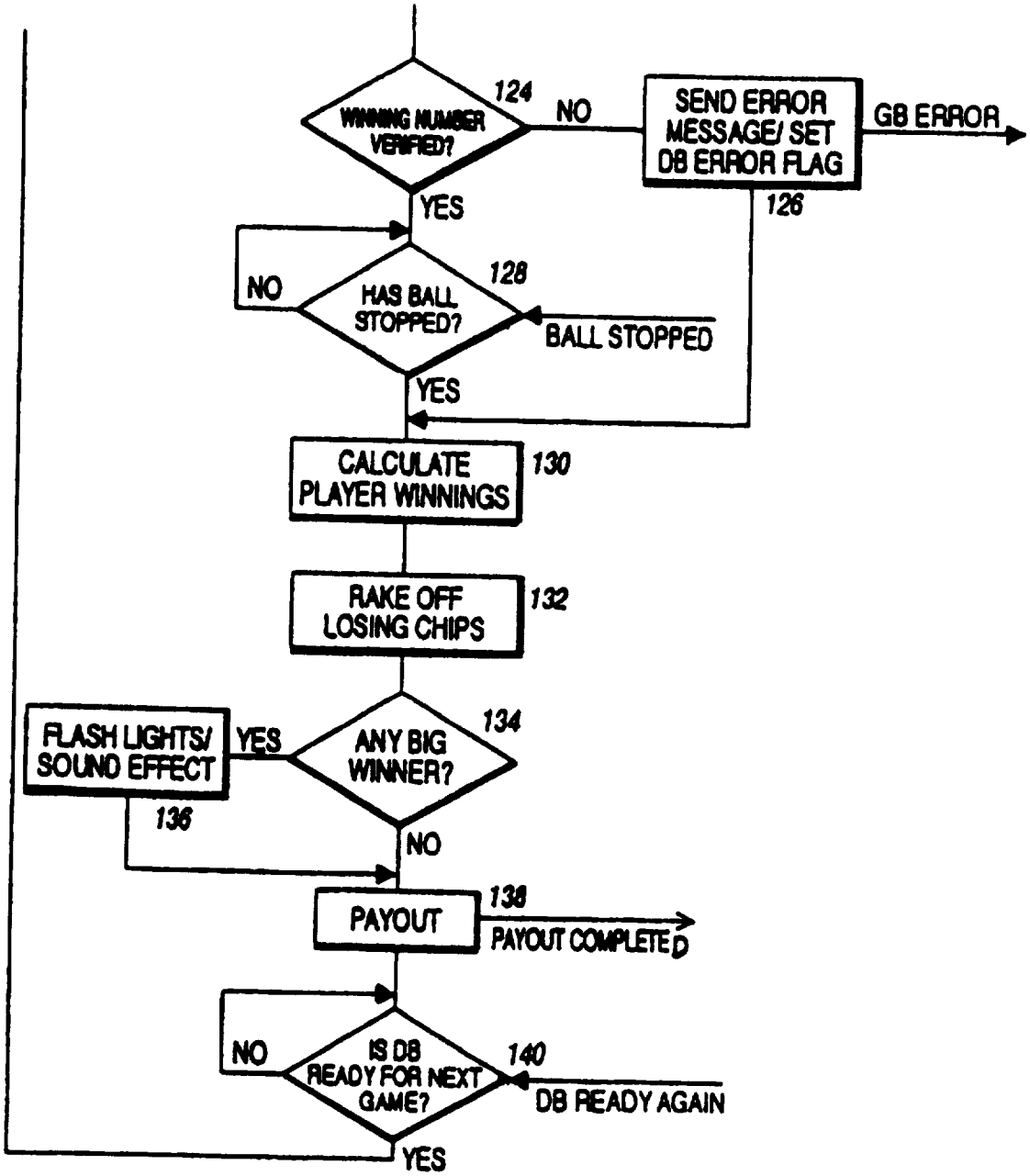
Figure 9A:
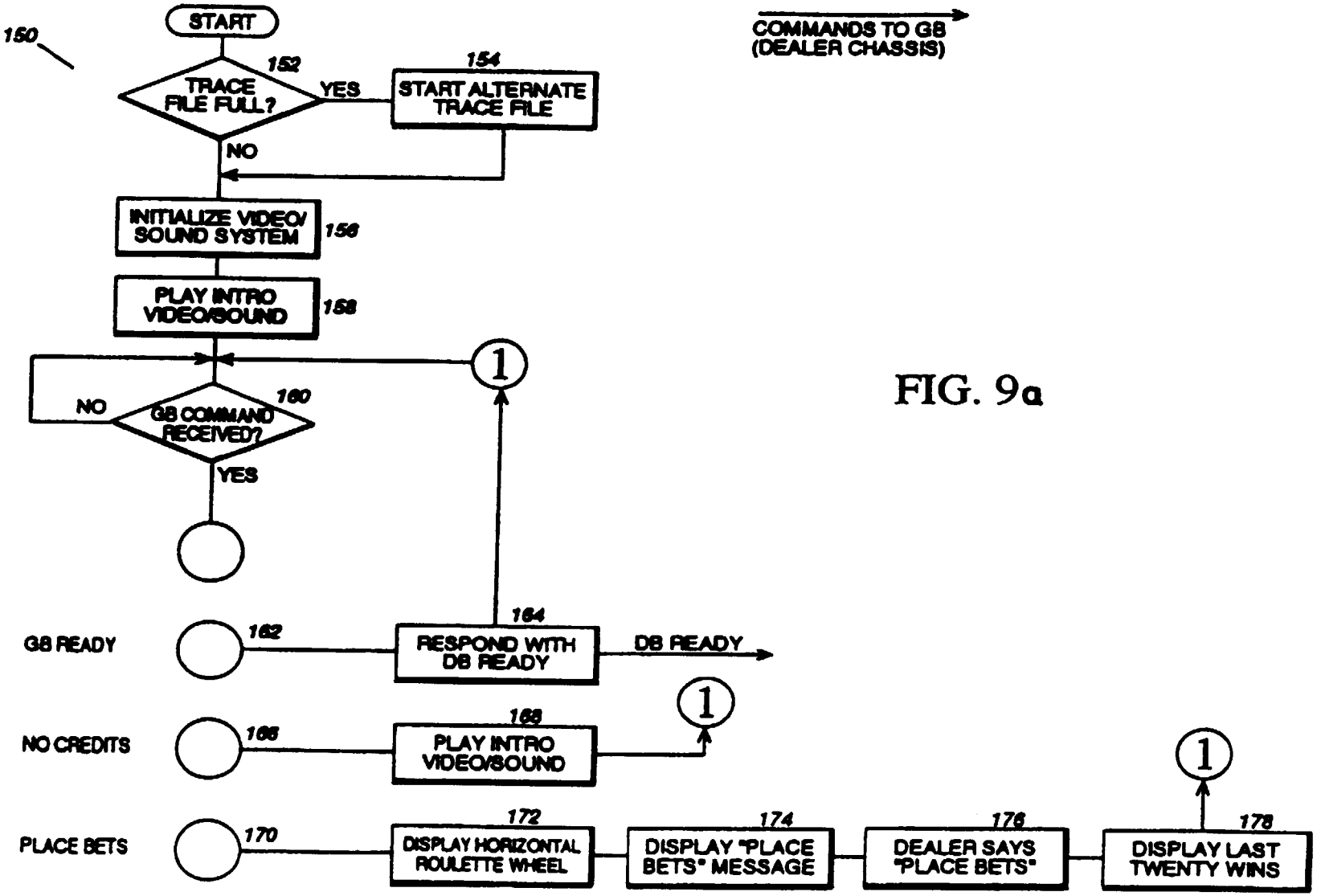
FIGS. 9A, 9B and 9C are flowcharts illustrating the operation of a display board (DB) routine in the gaming machine of FIG. 1.
Figure 9B:
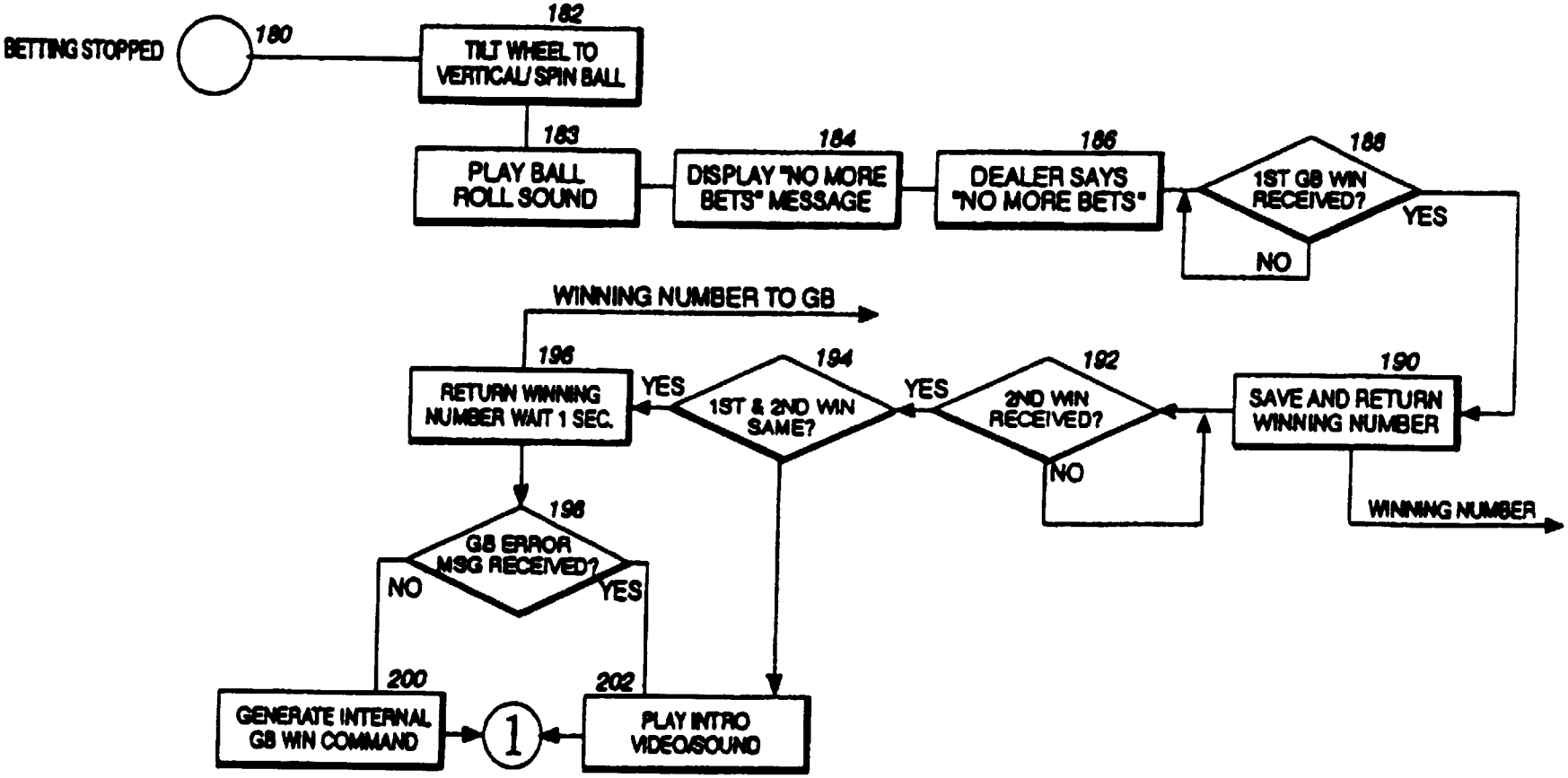
Figure 9C:
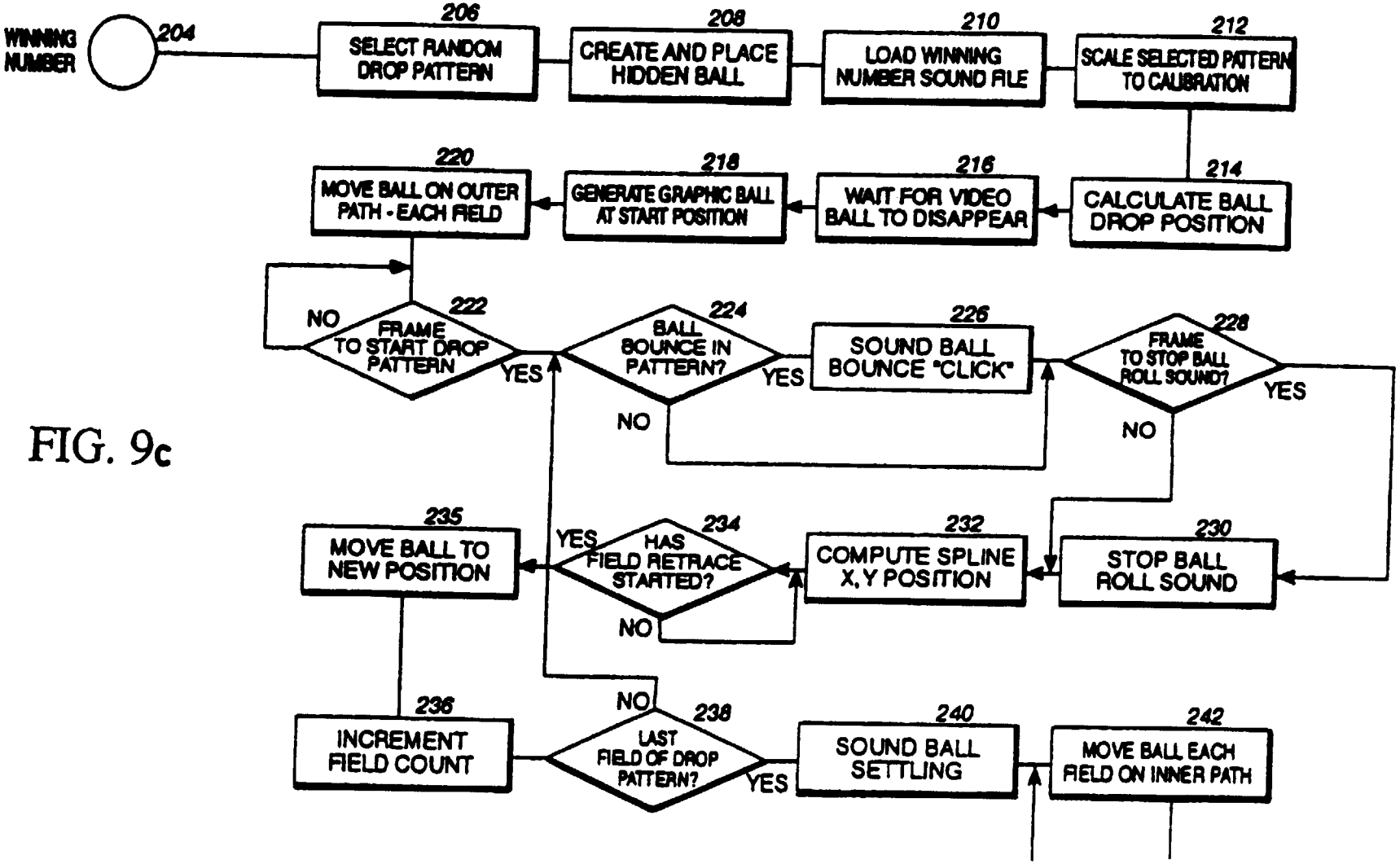
Figure 9D:
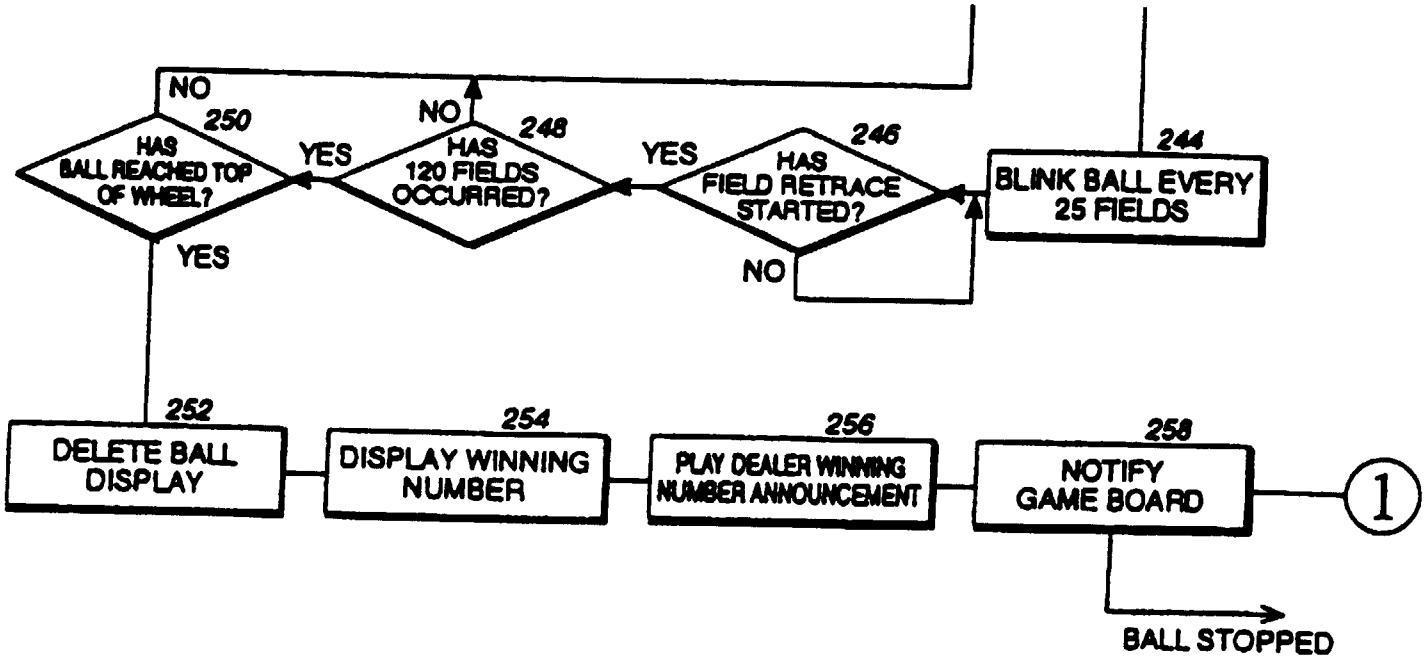
Figure 9E:
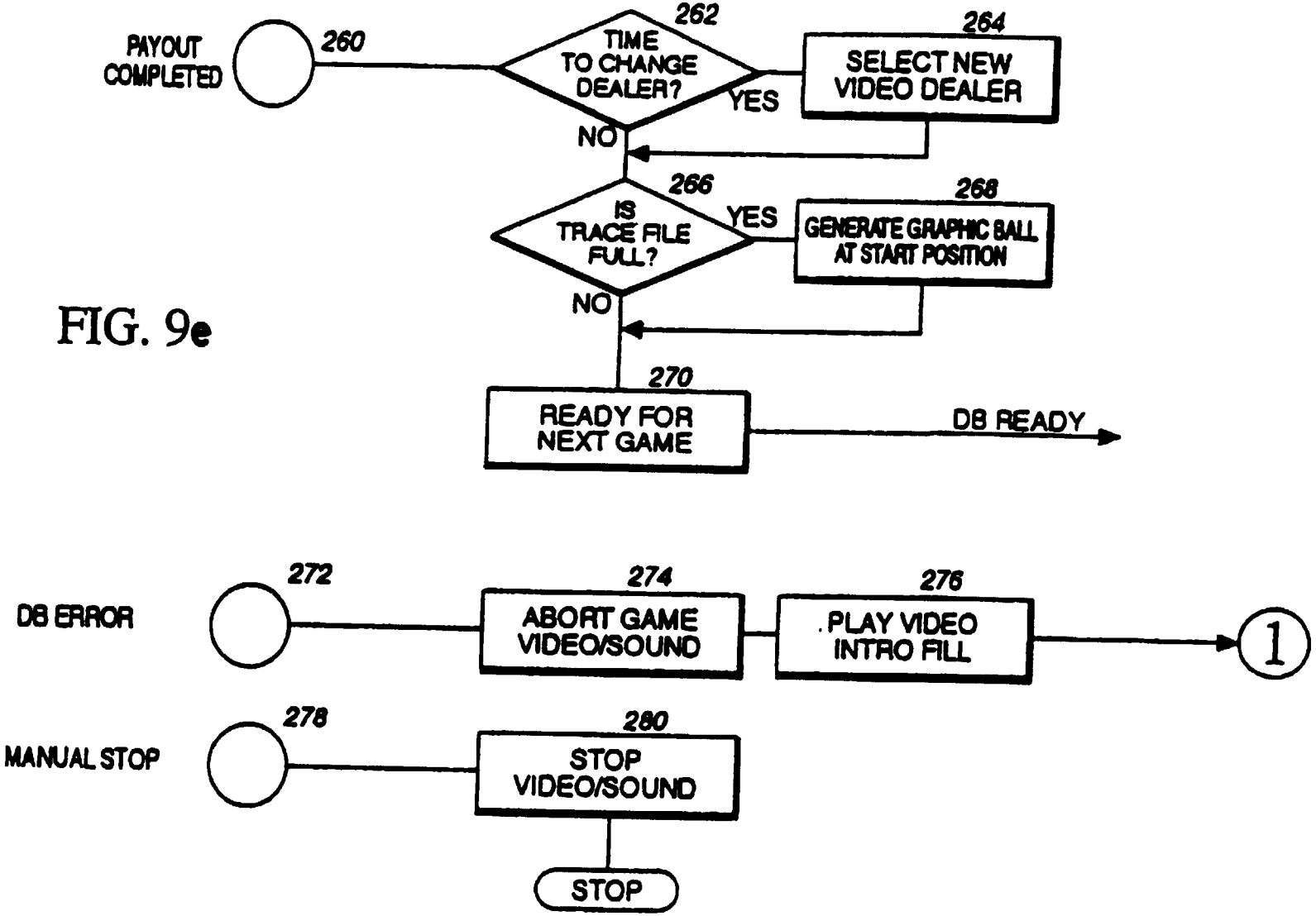

FIG. 8 illustrates a preferred program flow of a game board routine 100 (hereinafter the game board or GB) for game board chassis 31, as well as the interaction between game board chassis 31 and tower PC 80 in coordinating audio/video output in the machine. FIGS. 9A, 9B and 9C illustrate a preferred program flow of a display board routine 150 (hereinafter the display board or DB) for tower PC 80. In FIG. 8, all lines with arrows to the right are game board messages to the display board, while all lines with arrows pointing to the left are messages to the game board from the display board. The reverse is true for FIGS. 9A–9C. During these program sequences the game board also communicates with and processes inputs from each player station but an explanation of these functions is not necessary for an understanding of the invention.

Turning first to FIG. 8, on startup execution of game board routine 100 begins with block 102, where the machine is initialized, and internal checks are made to verify that the game board is ready to initiate a game of roulette. As a result, in block 104 the game board notifies the display board that it (GB) is ready to begin a game with a GB Ready message. Next, in block 106, the game board waits until a DB Ready message is received from the display board. Next, in block 108, the game board waits until credits are input into at least one of the player stations. If there are no credits, the display board is notified by a No Credits message to play a introduction video segment.

The betting phase begins at block 110 and lasts for a predefined time period, preferably using one of four values having been previously off-line selected (20 to 60 seconds). During this period, player bets are detected in block 112, and, if the timer started in block 110 has not expired, block 114 passes control to block 116 to process, record and display any bets on the game table. When block 114 detects that the betting time is over, the game board displays No More Bets on the game table, and sends a Betting Stopped message to the display board (block 118).

Next, the game board computes a random number in block 120, and in block 122 the (random) winning number is sent and received twice from the display board. After each exchange, the sent and received numbers are compared in block 124, and if the numbers are unequal, a GB Error message is sent to the display board and the DB error flag is set in block 126.

After the winning number comparisons are complete, the game board waits at block 128 for the video system to spin the ball, drop the ball through a bounce pattern, land on the winning number and rotate with the spinning roulette wheel for a few seconds, in a manner which will be described in greater detail below. When the ball reaches the top of the roulette wheel for the second time, the display board sends a Ball Stopped message to the game board, which passes control from block 128 to block 130. Then, the game board places the marker on the winning number and calculates the winning amounts for each player. The losing chips are raked off, and credit payout to winning players begins in block 132. If there are any big winners beyond certain thresholds, the winning player stations are notified (blocks 134 and 136) to flash colored lights on their control panel and to sound fanfare music from their speaker. Next, payout is performed in block 138, and when complete, a Payout Complete message is sent to the display board.

Once the payout is complete, the game board waits for a DB Ready Again message (block 140) which allows a variable time period for the display board to optionally display a message or video segment. Once the DB Ready Again message is received, control passes to block 142, and if the game board detected that the display board winning number was incorrect, the game board will complete the current game, but will not start a new game unless a DB Ready message is received from the display board in response to the GB Ready command of block 104. This prevents a new game from starting if the display board is not ready or not capable of communicating with the game board.

Next, the manner in which the display board program 150 controls the tower PC video system and maintains synchronism with the game board is illustrated in FIGS. 9A, 9B and 9C. Execution begins on power up at block 152, where the display board checks to see if the trace file maintained on the PC hard drive has reached maximum size. The program maintains a trace log which is a disk file containing most initialization actions, all command exchanges with the game board, and any observable error conditions and is for maintenance or troubleshooting purposes. If the trace file is full, the alternate file is made active and overwritten in block 154.

Next, at block 156 the communication and readiness of the video and sound system components are checked and initialized. Additionally at this time, two files are loaded from disk into the program, one of which defines the specific frame numbers of laser disk video events, such as, the start and end of each video segment, wheel tilt start, No More Bets announcement, last video ball frame, double zero (00) at wheel top, etc. The second file contains video ball calibration parameters used in block 212.

An off-line calibration program is preferably used to modify the initial default values of a set of ball parameters which precisely define the graphic ball movement and placement on a 640 by 480 VGA resolution monitor during the roulette game. The off-line program overlays the graphic ball on the video graphic image of the roulette wheel and it enables the ball parameters to be adjusted to match the actual wheel size, location and speed. Use of this program is preferred to account for variations in PC video cards, disk video and video monitors. The parameters and their units are:

$x_c$: the x coordinate center of the ball track (pixels)

$y_c$: the y coordinate center of the ball track (pixels)

$R_o$: the radius of the outer track (in pixels)

$R_i$: the radius of the inner track (in pixels)

$S_o$: the outer track speed in fields per revolution in a clockwise direction $S_i$: the inner track speed in fields per revolution in a counterclockwise direction An introduction video segment is started at block 158 and plays until at block 160 a GB Ready message is received from the game board.

The display board maintains a software switch which accepts game board commands and processes them as they are received. After a game board message is processed the display board again waits at block 160 for the next message, with the common return point to block 160 being designated by circle "1". The separate messages which may be received from the game board are illustrated in FIGS. 9A, 9B and 9C.

For example, at block 162 when the display board receives a GB ready message, a DB Ready is returned to the game board in block 164 to indicate that the video system is ready to play roulette. Control then returns to block 160.

Also, when a No Credits message is received at block 166, an introduction video segment is played in block 168. The video segment is programmed to preferably repeat until a Place Bets command is received from the game board.

Receipt of the Place Bets command at block 170 starts the first of two major phases of the roulette game. At block 172, a video segment begins to play which shows a spinning roulette wheel at about the same angle and distance as a typical player would see it at a live roulette table. Place Your Bets is displayed on the tower monitor (block 174) simultaneously with the appearance of the current dealer in a video window announcing "Place your bets" (block 176). After the dealer window disappears, a list of the last twenty winning number displays on the monitor (block 178) adjacent to the spinning roulette wheel, and control returns to block 160.

When a Betting Stopped message is received at block 180, the display board plays a video segment where the roulette wheel tilts from horizontal to vertical on the monitor screen for increased player visibility (block 182). At the same time the ball roll sound is initiated (block 183) and No More Bets is displayed on the tower monitor (block 184) simultaneously with the appearance of the current dealer in a video window announcing "No more bets" (block 186). The display board waits for the winning number from the game board in block 188 and, once received, immediately saves it and returns it to the game board in block 190.

Next, in block 192, the display board waits to receive the winning number for the second time and compares the two values received in block 194. If they are equal, the display board immediately returns the winning number to the game board in block 196. However, if the two received winning numbers are unequal, the display board stops the winning video segment and starts playing the introduction video segment in block 202. If the new number is equal to the first number, control passes to block 196.

At block 196, the display board waits one second for a possible error message, and if an error message is received (block 198), stops the current roulette wheel video and sound, and starts the intro video (block 202) and then waits for a new game board command (block 160). If at block 198 no error message is received, the display board generates an internal winning number command at block 200 which will then be processed by block 160.

The execution of the internal winning number command begins at block 204. First, in block 206 a randomly selected drop or bounce pattern is selected (preferably 1 of 20 coded). In general, the Tower PC generates a path for movement of a graphic image of a ball relative to the graphic image of the spinning roulette wheel. This path preferably has three components. In a first component, the graphic image of the ball moves around the outer track of the roulette wheel. In a second component, the ball drops from the outer track and follows a selected bounce pattern to land on the winning number bin. In a third component, the ball moves along with the roulette wheel while resting in the winning number bin.

The Tower PC first preferably selects a bounce pattern, then modifies the bounce pattern to compute start and stop points that will result in the ball landing in the appropriate bin. The start and stop points for the first and third components, when the ball is moving respectively along the outer and inner tracks of the roulette wheel, may then be determined from the modified bounce pattern.

Returning to FIG. 9B, in block 208 a roulette ball image, or sprite, is created from a disk (e.g., a PCX-format) file and placed on the screen in background (hidden) mode. The winning number announcement sound file is loaded into the sound card RAM in block 210. Then, in block 212, the bounce pattern coordinates are rescaled to agree with calibration values.

The preferred roulette bounce patterns may be created empirically from video taping actual roulette game action and observing balls drop. The patterns of the ball trajectory (after it falls from the rim along the outer track until it stops on the winning number bin along the inner track) may be analyzed, plotted and resolved into a plurality of unique, but typical, trajectory patterns. Ball trajectory may then be defined in terms of normalized (x, y) coordinates and field numbers (a value generally related to elapsed time, specifically a selected set of video intervals) and specified in a plurality of pattern tables. The initial part of the each pattern preferably decelerates the ball from its initial fixed speed until it reaches an estimated rim-fall speed, then a unique set of drop/bounce coordinates are defined.

Figure 10:
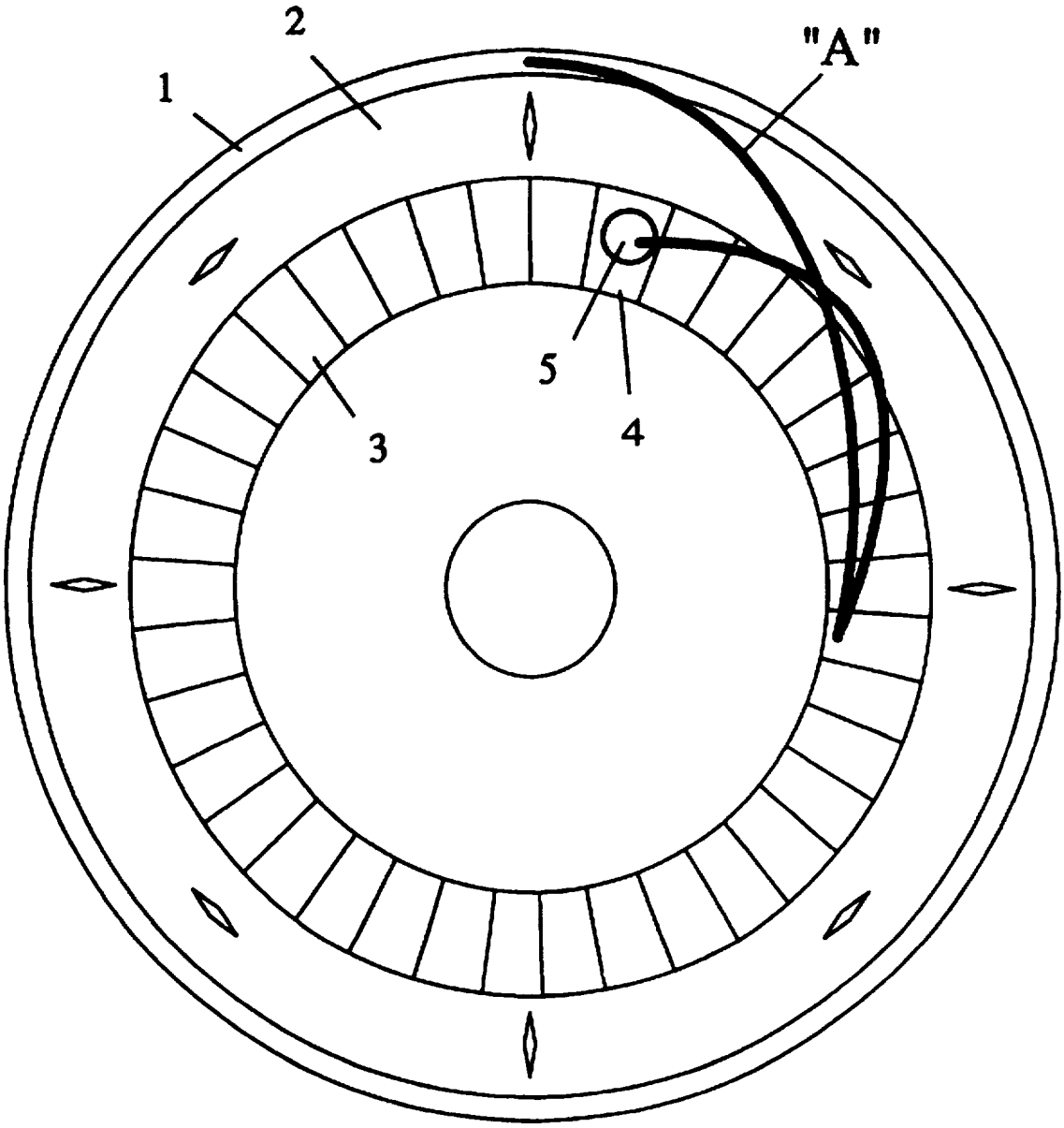
FIGS. 10 and 11 are functional top plan views of two exemplary bounce patterns for a ball relative to a roulette wheel for use with the gaming machine of FIG. 1.
Figure 11:
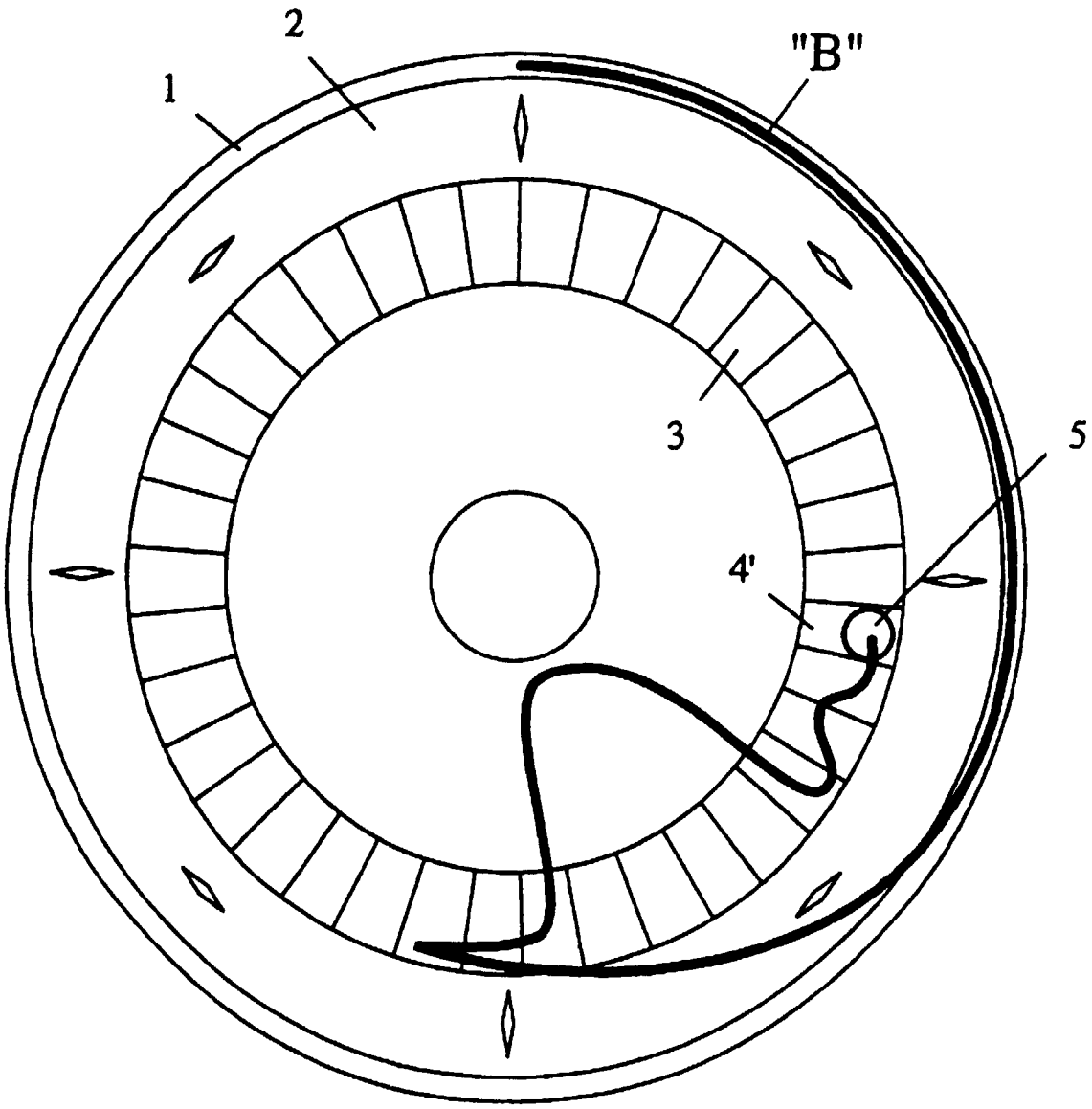

In the preferred embodiments, 20 bounce patterns are generated, which has been found to accurately simulate most typical bounce patterns encountered in an actual roulette game. For example, FIGS. 10 and 11 illustrate two exemplary bounce patterns "A" and "B" (for a graphic image of a ball 5) from the 20 bounce patterns generated for the preferred embodiments. Also shown is a graphic image of a roulette wheel 1 having outer and inner tracks 2, 3 with a plurality of bins (e.g., bins 4 and 4') disposed about the inner track. The normalized (x, y) coordinates (each normalized to a value between −1 and +1) and time indexes (preferably scaled values related to the field numbers) are provided in Tables I and II below:

TABLE I

Datapoints for Pattern "A" (FIG. 10)

| Datapoint | X-Coordinate | Y-Coordinate | Time Index |
|---|---|---|---|
| 1 | −0.340 | 0.940 | −1.000 |
| 2 | 0.000 | 1.000 | 0.000 |
| 3 | 0.342 | 0.940 | 20.000 |
| 4 | 0.643 | 0.766 | 41.111 |
| 5 | 0.866 | 0.500 | 63.333 |
| 6 | 0.985 | 0.174 | 86.667 |
| 7 | 0.985 | −0.174 | 111.111 |
| 8 | 0.866 | −0.500 | 136.667 |
| 9 | 0.643 | −0.766 | 163.333 |
| 10 | 0.342 | −0.940 | 191.111 |
| 11 | 0.000 | −1.000 | 220.000 |
| 12 | −0.342 | −0.940 | 250.000 |
| 13 | −0.643 | −0.766 | 281.111 |
| 14 | −0.866 | −0.500 | 313.333 |
| 15 | −0.985 | −0.174 | 346.667 |
| 16 | −0.985 | 0.174 | 381.111 |
| 17 | −0.866 | 0.500 | 416.667 |
| 18 | −0.643 | 0.766 | 453.333 |
| 19 | −0.342 | 0.940 | 491.111 |
| 20 | 0.000 | 1.000 | 530.000 |
| 21 | 0.310 | 0.850 | 570.000 |
| 22 | 0.520 | 0.620 | 610.000 |
| 23 | 0.620 | 0.360 | 650.000 |

TABLE I-continued

Datapoints for Pattern "A" (FIG. 10)

| Datapoint | X-Coordinate | Y-Coordinate | Time Index |
|---|---|---|---|
| 24 | 0.630 | 0.110 | 690.000 |
| 25 | 0.590 | −0.110 | 730.000 |
| 26 | 0.590 | −0.110 | 730.000 |
| 27 | 0.710 | 0.120 | 770.000 |
| 28 | 0.690 | 0.390 | 810.000 |
| 29 | 0.530 | 0.640 | 850.000 |
| 30 | 0.230 | 0.750 | 890.000 |
| 31 | 0.230 | 0.750 | 891.000 |

TABLE II

Datapoints for Pattern "B" (FIG. 11)

| Datapoint | X-Coordinate | Y-Coordinate | Time Index |
|---|---|---|---|
| 1 | −0.340 | 0.940 | −1.000 |
| 2 | 0.000 | 1.000 | 0.000 |
| 3 | 0.342 | 0.940 | 20.000 |
| 4 | 0.643 | 0.766 | 41.111 |
| 5 | 0.866 | 0.500 | 63.333 |
| 6 | 0.985 | 0.174 | 86.667 |
| 7 | 0.985 | −0.174 | 111.111 |
| 8 | 0.866 | −0.500 | 136.667 |
| 9 | 0.643 | −0.766 | 163.333 |
| 10 | 0.342 | −0.940 | 191.111 |
| 11 | 0.000 | −1.000 | 220.000 |
| 12 | −0.342 | −0.940 | 250.000 |
| 13 | −0.643 | −0.766 | 281.111 |
| 14 | −0.866 | −0.500 | 313.333 |
| 15 | −0.985 | −0.174 | 346.667 |
| 16 | −0.985 | 0.174 | 381.111 |
| 17 | −0.866 | 0.500 | 416.667 |
| 18 | −0.643 | 0.766 | 453.333 |
| 19 | −0.342 | 0.940 | 491.111 |
| 20 | 0.000 | 1.000 | 530.000 |
| 21 | 0.340 | 0.930 | 570.000 |
| 22 | 0.630 | 0.740 | 610.000 |
| 23 | 0.840 | 0.490 | 650.000 |
| 24 | 0.960 | 0.170 | 690.000 |
| 25 | 0.960 | −0.170 | 730.000 |
| 26 | 0.830 | −0.490 | 770.000 |
| 27 | 0.580 | −0.690 | 810.000 |
| 28 | 0.280 | −0.770 | 850.000 |
| 29 | 0.000 | −0.790 | 890.000 |
| 30 | −0.150 | −0.730 | 914.000 |
| 31 | 0.070 | −0.730 | 944.000 |
| 32 | 0.090 | −0.500 | 974.000 |
| 33 | 0.110 | −0.250 | 1004.000 |
| 34 | 0.400 | −0.330 | 1034.000 |
| 35 | 0.630 | −0.400 | 1064.000 |
| 36 | 0.640 | −0.250 | 1084.000 |
| 37 | 0.740 | −0.220 | 1104.000 |
| 38 | 0.740 | −0.220 | 1105.000 |

These bounce patterns are normalized to start at a top dead center position (0,1) and end in a bin relative to this top dead center position. However, to accommodate for different winning numbers, the selected normalized bounce pattern must be modified by the tower PC to determine appropriate start and stop points for the bounce pattern to begin and end relative to the spinning roulette wheel. It should be appreciated that the above bounce patterns may start with the second datapoints, with the first datapoints being used as initial values in the path determination. It should also be appreciated that, as with patterns "A" and "B", different patterns may have different lengths (numbers of data points), reflecting different elapsed times for the patterns, which also affects these start and stop points.

In block 212 the display board program uses the predefined ball parameters (loaded in block 156) to re-compute the selected pattern to values consistent with the off-line calibrated values. Based on the selected drop pattern, ball and wheel parameters, a ball drop position (corresponding to the start point of the selected bounce pattern) is calculated (block 214). The computations required are explained here in some detail:

First, the number of fields MF specified in the selected drop pattern table is determined. Then $S_R$, the rate of ball movement relative to any fixed position on the wheel, is computed:

$$S_R = \frac{1}{S_o} + \frac{1}{S_i}$$

where $S_o$ is the outer ball track speed, and $S_i$ is the inner ball track speed, and where $1/S_R$ is the number of fields between the ball aligning each revolution with a given number on the wheel.

$DF_1$ is the number of fields to drop the ball to "00" (or "0" for European roulette), based on the number of fields in the pattern, and ball and wheel rotation rates. This value is calculated with the equation:

$$DF_1 = \frac{2 \times \text{LastFrameWithBall}}{S_o} + \frac{2 \times \text{Frame00atTop} - MF}{S_i}$$

$DF_2$ is the fraction of the circle the ball travels in the selected drop pattern to land on the winning number. This value is calculated with the equation:

$$DF_2 = DF_1 + \frac{\arctan 2(y, x)}{2\pi} - \frac{WP}{38}$$

where the value "arctan 2 (y,x)/2Π" is that fraction of a full circle that the ball actually moves during its drop, where (y, x) are the coordinates based on the selected pattern where the ball would land if the drop started at the top of the wheel, where WP is the position on the circle where the winning number is located relative to "00" (as the numbers are distributed non-sequentially around a roulette wheel), and where WP/38 is the fraction of a full circle that the winning number is away from "00".

DF, the number of fields required to accomplish $DF_2$, is then calculated from the equation:

$$DF = \frac{DF_2}{S_R}$$

At block 216 the display board waits for completion of the last video frame containing the pre-recorded video ball circling the roulette wheel (a beginning field number). The PC requests the current video frame number from the laser player and thereafter counts every field retrace so that the display board program always knows the current field/frame number. When the vertical retrace interval begins (block 218), the graphic ball is activated at its start position for the next field, thereby providing a smooth transition between the pre-recorded video ball and the computer generated graphic image of the ball. The graphic ball position on the outer track is computed after each field trace completes and output to the monitor (block 220). The new ball image (x, y) position in pixels is:

$\Theta = \pi/2$ the last pre-recorded video ball position(arbitrarily, 9 o'clock)

$\Delta\Theta = -2\pi/S_o$ the angular displacement in radians per field $x = R_o\cos(\Theta + \Delta\Theta) + x_c$ $y = -R_o\sin(\Theta + \Delta\Theta) + y_c$ The graphic ball circles the roulette wheel (outer track) for somewhat less than two revolutions until the computed bounce pattern start point $DF_s$ is reached (block 222), then the special processing required for the ball bounce pattern begins. $DF_s$ is calculated as follows:

$DF_s = nDF + 2/S_R$ where $n$ is incremented until $nDF$ is greater than 2 × the Last Frame with the Ball.

Two sets of coordinate entries are read from the pattern table and compared in each program loop to locate a bounce point (block 224). A bounce point is defined by two identical table field entries with the same coordinate values, although other manners of indicating bounce points, e.g., using a separate variable, may also be used. If a bounce point is found a ball bounce or "click" sound is initiated (block 226). After the ball pattern has considerably slowed the ball speed (block 228), the ball roll sound is stopped (block 230).

For each field a new position of the ball is computed by using position and time coordinates from the pattern table and an interpolation function, e.g., a Catmull-ROM cubic spline computation, is performed to provide a smoothed more realistic ball trajectory between pattern table coordinate values (block 232). The program waits until notified that a retrace interval has started (block 234), then moves the ball to its new coordinate position (block 235). The field count is incremented (block 236), and a check made to see if the last field of the bounce pattern (the stop point) has been reached (block 238). If not, the program returns to block 224 to begin the processing for the next field. If yes, the ball settling sound is initiated (block 240).

At this point, the ball has landed on the roulette wheel winning number. In block 242 the ball is moved on its inner track every field per its defined inner track speed and radius in order to properly maintain its position on the graphic image of the spinning roulette wheel. The new ball image (x y) position in pixels is:

$\Theta =$ bounce pattern stop point position(i.e., the winning number bin or slot)

$\Delta\Theta = 2\pi/S_i$ the angular displacement in radians per field $x = R_i\cos(\Theta + \Delta\Theta) + x_c$ $y = -R_i\sin(\Theta + \Delta\Theta) + y_c$ The ball is also preferably blinked every 25 fields to permit players to more easily see the winning number (block 244). The program waits until each retrace starts (block 246), then checks to see if a predetermined number of fields (e.g., 120) have occurred (block 248), to assure that the ball is displayed on the wheel for an appropriate period of time preferably between about 2 and 6 seconds. The field count is incremented, and in block 250 a check is made to see if the ball has reached the top of the wheel (as the wheel at this point is preferably displayed vertically on the monitor screen). If no, the program returns to block 242 to process the next field. If yes, the ball image is deleted from the display (block 252).

Next, the appropriate winning number graphic (e.g., from a PCX file) is displayed on the screen for a few seconds in block 254. In block 256 the dealer announcement of the winning number is initiated from the sound card from which it was stored in block 210. The display board then sends a Ball Stopped message to the game (dealer) board in block 258 and the program returns to block 160 to await the next game board command.

When the Payout Completed message is received, program control passes to block 260. Block 262 checks if it is time to change the dealer (which may occur based upon time, number of rounds, etc.). If yes, at block 264 the display board is set to play the new video segment. At block 266 a check is made to see if the trace file is full, and if full, the program switches to begin re-writing the alternate trace file (block 268). Next, at block 270 the display board sends the DB Ready Again message to notify the game board to start a new game. Control then returns to block 160 to process additional game board messages.

When the DB Error message is received at block 272, the display board executes block 274 to abort the current video segment and stop the current sound stream. Next, at block 276, the display board starts the intro video segment and returns to block 160.

A keyboard may optionally be connected to the game board control panel (not shown), and if an operator enters a Manual Stop command at block 278, the display board program, and video system video and sound functions are stopped in block 280.

It will be appreciated that the various programs, routines and graphical/video data disclosed herein are resident at different times on one or more "program storage devices." As used herein, the term "program storage device" may include any device or apparatus capable of storing information either in a volatile or non-volatile manner. Accordingly, a program storage device may comprise memory devices such as RAMs, ROMs, EPROMs, processor and cache memories, flash memories, customized integrated circuits, etc., as well as fixed or removable mass storage medias such as magnetic disks (fixed or removable), CD-ROMs, magnetic tape, etc. Thus, a program storage device may be any of the memories and storage devices disclosed for machine 10, or may also be a CD-ROM, floppy disk, or other medium which is used to load the software into machine 10.

In addition, it will be appreciated that the various programs, routines and graphic/video data (generically "program products") may be transferred or downloaded to a machine or computer system via network or modem in lieu of being provided on a storage medium such as a floppy disk or CD-ROM, typically by first establishing a connection between the machine and a server-type computer, and thereafter transmitting the program product to the machine. Thus, it will be appreciated that a "program storage device" may also include any of the aforementioned memory and storage media of a server-type computer (e.g., a bulletin board or ftp site) which downloads or transfers a program product to other computer systems but does not actually execute the downloaded or transferred program product.

Various modifications may be made to the preferred embodiments without departing from the spirit and scope of the invention. As other modifications will be apparent to one skilled in the art, the invention therefore lies in the claims hereinafter appended.

What is claimed is:

1. An electronic roulette gaming apparatus, comprising:

(a) a display;

(b) a storage device outputting a pre-recorded graphic image of a spinning roulette wheel to the display; and (c) a controller outputting a superimposed graphic image of a ball to the display, wherein the controller synchronizes movement of the graphic image of the ball with the pre-recorded graphic image of the spinning roulette wheel to simulate movement of a ball on a roulette wheel.

2. The apparatus of claim 1, further comprising a random number generator generating a random winning number.

3. The apparatus of claim 2, wherein the controller generates a path for movement of the graphic image of the ball relative to the pre-recorded graphic image of the spinning roulette wheel by selecting one of a plurality of bounce patterns, each bounce pattern comprising a plurality of datapoints for moving the graphic image of the ball from an outer track to an inner track of the pre-recorded graphic image of the roulette wheel, and wherein the controller modifies the selected bounce pattern to stop the graphic image of the ball at a bin on the inner track of the pre-recorded graphic image of the roulette wheel corresponding to the random winning number.

4. The apparatus of claim 3, wherein the controller recalculates the position of the graphic image of the ball during retrace periods of the display, and wherein the controller interpolates the position of the graphic image of the ball between datapoints by performing a spline computation.

5. The apparatus of claim 3, wherein the controller calculates start and stop points for the selected bounce pattern, moves the graphic image of the ball along the outer track of the graphic image of the roulette wheel prior to the start point of the selected bounce pattern, and moves the graphic image of the ball along the inner track of the graphic image of the roulette wheel after the stop point of the selected bounce pattern.

6. The apparatus of claim 1, wherein the storage device is a laser disk player.

7. The apparatus of claim 1, wherein the storage device is a hard disk drive.

8. The apparatus of claim 1, further comprising:

(a) a plurality of player stations, each for receiving player input; and (b) a game table, coupled to the first controller and the player stations, the game table including:

(1) a second display which displays a betting field; and (2) a second controller, coupled to the display, that coordinates the operation of the apparatus, wherein the first and second controllers pass a random winning number back and forth at least two times prior to initiating movement of the graphic image of the ball.

9. The apparatus of claim 1, further comprising a sound card, coupled to the controller, the sound card including an on-board memory loaded with ball and winning number sounds, wherein the sound card plays sounds stored in the memory in response to commands from the controller.

10. An electronic roulette gaming apparatus, comprising:

(a) first display means for displaying a graphic image of a spinning roulette wheel on a display;

(b) determining means for pre-determining a specific path for movement of a graphic image of a ball on the display relative to the graphic image of the spinning roulette wheel, prior to the start of the display of the graphic image of the ball wherein the determining means selects a bounce pattern for the graphic image of the ball from a plurality of different bounce patterns, each bounce pattern for moving the graphic image of the ball from an outer track to an inner track of the graphic image of the spinning roulette wheel; and (c) second display means for superimposing the graphic image of the ball on the display and moving the graphic image of the ball relative to the graphic image of the spinning roulette wheel to follow the pre-determined path.

11. The apparatus of claim 10, wherein the first display means plays a pre-recorded graphic image, and wherein the second display means synchronizes movement of the graphic image of the ball with the playing of the pre-recorded graphic image.

12. The apparatus of claim 11, wherein the bounce pattern includes a table of datapoints, each datapoint including x and y coordinates, wherein the determining means modifies the bounce pattern to stop the ball at a bin on the inner track of the graphic image of the roulette wheel corresponding to a winning number, wherein the second display means interpolates the position of the graphic image of the ball between datapoints by performing a spline computation and recalculates the position of the graphic image of the ball during retrace periods of the display.

13. The apparatus of claim 11, wherein the pre-recorded graphic image includes a graphic image of a dealer that provides status information to players.

14. A method of playing roulette, the method comprising the steps of:

(a) playing a pre-recorded graphic image of a spinning roulette wheel on a display;

(b) superimposing a graphic image of a ball over the pre-recorded graphic image of the spinning roulette wheel;

(c) determining a path for movement of the graphic image of the ball relative to the pre-recorded graphic image of the spinning roulette wheel; and (d) synchronizing movement of the graphic image of the ball along the path with the playing of the pre-recorded graphic image of the spinning roulette wheel.

15. The method of claim 14, wherein the determining step includes the step of generating a random winning number.

16. The method of claim 15, wherein the determining step further includes the steps of:

(a) determining a bounce pattern for moving the graphic image of the ball from an outer track to an inner track of the pre-recorded graphic image of the roulette wheel; and (b) modifying the bounce pattern to stop the graphic image of the ball at a bin on the inner track of the pre-recorded graphic image of the roulette wheel corresponding to the random winning number.

17. The method of claim 16, wherein the step of determining the bounce pattern includes the step of randomly selecting the bounce pattern from a plurality of bounce patterns, each of which simulates a pattern that is typical in an actual game of roulette.

18. The method of claim 16, wherein the bounce pattern comprises a table of datapoints, each datapoint including x and y coordinates.

19. The method of claim 18, wherein each datapoint in the bounce pattern further includes a field coordinate representative of elapsed time, and wherein the synchronizing step includes the steps of:

(a) monitoring a current field number for the pre-recorded graphic image of the spinning roulette wheel; and (b) for each datapoint in the bounce pattern, moving the graphic image of the ball to a position related to the x and y coordinates of the datapoint when the field coordinate of the datapoint matches the current field number for the pre-recorded graphic image of the spinning roulette wheel.

20. The method of claim 19, wherein the synchronizing step recalculates the position of the graphic image of the ball during retrace periods of the display, and wherein the synchronizing step further includes the step of interpolating the position of the graphic image of the ball between datapoints by performing a spline computation.

21. The method of claim 19, wherein the pre-recorded graphic image of the spinning roulette wheel includes a pre-recorded ball circling the outer track of the roulette wheel until a beginning field number of the pre-recorded graphic image, at which time the pre-recorded ball disappears and wherein the superimposing step includes the step of positioning the graphic image of the ball directly over the position of the pre-recorded ball to provide a smooth transition from the pre-recorded ball to the graphic image of the ball when the pre-recorded ball disappears.

22. The method of claim 19, wherein the synchronizing step includes the step of playing a bounce sound when two identical datapoints in the bounce pattern are encountered.

23. The method of claim 16, wherein the determining step includes the step of determining start and stop points for the bounce pattern, and wherein the synchronizing step further includes the steps of:

(a) prior to the start point of the bounce pattern, moving the graphic image of the ball along the outer track in a direction opposite that of the spinning roulette wheel in the pre-recorded image; and (b) after the stop point of the bounce pattern, moving the graphic image of the ball along the inner track at a fixed rate related to a rotational speed of the spinning roulette wheel in the pre-recorded image.

24. A method of playing roulette, the method comprising the steps of:

(a) displaying a graphic image of a spinning roulette wheel on a display;

(b) displaying a graphic image of a ball over the graphic image of the spinning roulette wheel;

(c) pre-determining a specific path for movement of the graphic image of the ball relative to the graphic image of the spinning roulette wheel prior to the start of the display of the graphic image of the ball including the step of selecting a bounce pattern for the graphic image of the ball from a plurality of different bounce patterns, each bounce pattern for moving the graphic image of the ball from an outer track to an inner track of the graphic image of the spinning roulette wheel; and (d) moving the graphic image of the ball relative to the graphic image of the spinning roulette wheel to follow the path.

25. The method of claim 24, wherein the step of displaying the graphic image of the spinning roulette wheel comprises the step of playing a pre-recorded graphic image, and wherein the moving step includes the step of synchronizing movement of the graphic image of the ball with the playing of the pre-recorded graphic image of the spinning roulette wheel.

26. The method of claim 25, wherein the determining step includes the steps of:

(a) generating a random winning number; and (b) modifying the bounce pattern to stop the ball at a bin on the inner track of the graphic image of the roulette wheel corresponding to the random winning number.

27. The method of claim 25, wherein the bounce pattern includes a table of datapoints, each datapoint including x and y coordinates, wherein the synchronizing step recalculates the position of the graphic image of the ball during retrace periods of the display, and wherein the synchronizing step further includes the step of interpolating the position of the graphic image of the ball between datapoints by performing a spline computation.

28. A program storage device readable by a computer system coupled to a display, the program storage device tangibly embodying a program of instructions executable by the computer system to simulate a live action roulette game on the display, the program comprising:

(a) first display means for displaying a graphic image of a spinning roulette wheel on the display;

(b) pre-determining means for determining a specific path for movement of a graphic image of a ball on the display relative to the graphic image of the spinning roulette wheel, prior to the start of the display of the graphic image of the ball wherein the determining means selects a bounce pattern for the graphic image of the ball from a plurality of different bounce patterns, each bounce pattern for moving the graphic image of the ball from an outer track to an inner track of the graphic image of the spinning roulette wheel; and (c) second display means for superimposing the graphic image of the ball on the display and moving the graphic image of the ball relative to the graphic image of the spinning roulette wheel to follow the path.

29. An electronic roulette gaming apparatus, comprising:

(a) first display means for displaying a graphic image of a spinning roulette wheel on a display, wherein said first display means plays a pre-recorded graphic image;

(b) determining means for determining a path for movement of a graphic image of a ball on the display relative to the graphic image of the spinning roulette wheel, wherein the determining means selects a bounce pattern for the graphic image of the ball from a plurality of different bounce patterns, each bounce pattern for moving the graphic image of the ball from an outer tract to an inner track of the spinning roulette wheel, wherein said bounce pattern includes a table of datapoints, each datapoint including x and y coordinates, wherein the determining means modifies the bounce pattern to stop the ball at a bin on the inner track of the graphic image of the roulette wheel corresponding to a winning number; and (c) second display means for displaying the graphic image of the ball on the display and moving the graphic image of the ball relative to the graphic image of the spinning roulette wheel to follow the path, wherein the second display means synchronizes movement of the graphic image of the ball with the playing of the pre-recorded graphic image of the spinning roulette wheel, and wherein the second display means interpolates the position of the graphic image of the ball between datapoints by performing spline computation and recalculates the position of the graphic image of the ball during the retrace periods of the display.

30. A method of playing roulette, the method comprising the steps of:

(a) displaying a graphic image of a spinning roulette wheel on a display, wherein said displaying step comprises the step of playing a pre-recorded graphic image;

(b) displaying a graphic image of a ball over the graphic image of the spinning roulette wheel;

(c) determining a path for movement of the graphic image of the ball relative to the graphic image of the spinning roulette wheel including the step of selecting a bounce pattern for the graphic image of the ball from the outer track to an inner track of the graphic image of the spinning roulette wheel, wherein said bounce pattern includes a table of datapoints, each datapoint including x and y coordinates; and (d) moving the graphic image of the ball relative to the graphic image of the spinning roulette wheel to follow the path, wherein said moving step includes the step of synchronizing movement of the graphic image of the ball with the playing of the pre-recorded graphic image, wherein said synchronizing step recalculates the position of the graphic image of the ball during retrace periods of the display, and wherein said synchronizing step further includes the step of interpolating the position of the graphic image of the ball between datapoints by performing a spline compilation.

* * * * *

UNITED STATES PATENT AND TRADEMARK OFFICE

CERTIFICATE OF CORRECTION

PATENT NO. : 5,775,993

DATED : JULY 7, 1998

INVENTOR(S) : FENTZ ET AL.

It is certified that error appears in the above-identified patent and that said Letters Patent is hereby corrected as shown below:

On the title page:

Item: [56] References Cited: insert the following references in appropriate numerical order: —4,614,342 9/1986 Takashima—, —5,263,715 11/1993 Matsumoto et al.—, and —5,497,461 3/1996 Matsumoto et al.—

Signed and Sealed this

Second Day of November, 1999

*Attest:*

*Attesting Officer*

Q. TODD DICKINSON

*Acting Commissioner of Patents and Trademarks*